US012790843B2

(12) United States Patent
Carter et al.

(10) Patent No.: US 12,790,843 B2
(45) Date of Patent: Nov. 10, 2026

(54) TELESCOPIC SEATING GUARDRAIL STORAGE SYSTEM AND METHOD

(71) Applicant: Hussey Seating Company, North Berwick, ME (US)

(72) Inventors: Gerald S Carter, Shapleigh, ME (US); Jordan Pidgeon, York, ME (US)

(73) Assignee: Hussey Seating Company, North Berwick, ME (US)

( * ) Notice: Subject to any disclaimer, the term of this patent is extended or adjusted under 35 U.S.C. 154(b) by 203 days.

(21) Appl. No.: 18/740,789

(22) Filed: Jun. 12, 2024

(65) Prior Publication Data

US 2025/0092699 A1 Mar. 20, 2025

Related U.S. Application Data

(60) Provisional application No. 63/472,537, filed on Jun. 12, 2023.

(51) Int. Cl.

| | |
|---|---|
| ***E04H 3/30*** | (2006.01) |
| ***E04F 11/18*** | (2006.01) |
| ***E04G 5/14*** | (2006.01) |
| ***E04H 3/12*** | (2006.01) |

(52) U.S. Cl.

CPC ..... *E04H 3/30* (2013.01); *E04F 11/1865* (2013.01); *E04G 5/14* (2013.01); *E04H 3/123* (2013.01)

(58) Field of Classification Search

CPC .. E04H 3/30; E04H 3/123; E04G 5/14; E04G 5/142; E04F 2011/1885; E04F 11/1865

See application file for complete search history.

(56) References Cited

U.S. PATENT DOCUMENTS

| | | | | |
|---|---|---|---|---|
| 5,813,663 | A * | 9/1998 | Victor | E04H 3/123 52/9 |
| 5,820,110 | A * | 10/1998 | Beu | E04H 3/123 52/9 |
| 6,076,306 | A * | 6/2000 | Victor | E04H 3/123 52/9 |
| 6,328,285 | B1 * | 12/2001 | Wiseman | E04H 12/2269 256/67 |
| 9,650,796 | B2 * | 5/2017 | Klingenberg | E04H 3/123 |
| 10,053,881 | B2 * | 8/2018 | Briggs | E04H 3/123 |
| 11,466,462 | B2 * | 10/2022 | Shelton | E04F 11/1865 |
| 2002/0056239 | A1 * | 5/2002 | Paddock | E04H 3/12 52/9 |
| 2025/0092699 | A1 * | 3/2025 | Carter | E04H 3/30 |

* cited by examiner

*Primary Examiner* — Andrew J Triggs
(74) *Attorney, Agent, or Firm* — Robinson + Cole LLP

(57) ABSTRACT

A guardrail storage system in a multi-tiered seating wherein the storage system is configured for securing an end guardrail in a use position substantially parallel to an end of the tier, and in a storage position substantially parallel to a front beam of the tier.

20 Claims, 24 Drawing Sheets

TELESCOPIC SEATING GUARDRAIL STORAGE SYSTEM AND METHOD

CROSS-REFERENCE TO RELATED APPLICATION

This application claims priority from United States Provisional Patent Application No. 63/472,537 titled "TELESCOPIC SEATING GUARDRAIL STORAGE SYSTEM AND METHOD", which was filed on Jun. 12, 2023, which is incorporated fully herein by reference.

TECHNICAL FIELD

The present invention generally relates to the field of telescopic seating, and more particularly, to storing guardrails on retracted telescopic seating.

BACKGROUND INFORMATION

A common feature in spectator seating venues is a multi-tiered telescopic bank of seating platforms. Folding and telescopic seating structures, also referred to in this disclosure as folding or retractable seating or bleachers without limiting such structures, can be retracted into a vertical stack of tiered seating to provide access to additional usable floor space that would otherwise be covered by the seating structure. These structures are typically installed in, without limitation, school gymnasiums, theaters, arenas or stadiums. An example of such seating structures includes Hussey Seating Company's MXP and Maxam product lines.

FIG. 1A shows an example of a Prior Art retractable seating structure 10 in an open, extended configuration. In this open configuration, the tiers 12 have been pulled away from the wall 2 along the floor 1 until the back beam 17 (also known as a "riser") of an extended tier 12 is adjacent the front beam 15 (also known as a "nose") of the next higher tier. Each tier, or platform, 12 of seating, when opened or closed, needs to slide past or under adjacent tiers. FIG. 1B shows retractable seating structure 10 in a closed, retracted configuration where each tier 12 is moved towards the wall 2 to its most compact arrangement.

FIGS. 2A and 2B show top views of the seating structure 10 of FIGS. 1A and 1B. As the tiers 12 are retracted in direction W toward wall 2, an amount b of additional floor space is exposed. Maximizing this additional floor space allows for uses of a venue not otherwise available.

To increase the safety of seating structures, building codes require railed ends (guardrails) on tiers higher than a specified height (e.g. thirty inches in some codes) from the floor and without an adjacent surface. On typical telescopic platforms, such required guardrails would prevent a lower tier from retracting under a higher tier because of contact therewith, such as in the case of tiers with tapered ends, and therefore must be removed or moved out of the way prior to retracting the tiered seating platforms to a closed vertical stack. See FIG. 1B for a top view of an example of retractable seating with a tapered end on one side and a straight end on the other side. Tapered ends are utilized to match building features and available floor spaces.

This operation is very common in all venues that have telescopic seating. This process is part of what facilities call a "changeover", meaning converting a venue from one configuration to another (for example converting from a hockey set up to a basketball set up). A key factor in determining how many different events a venue can host is changeover time, that is the time it takes to convert from one configuration to another. The faster the changeover time, the more ticketed events a venue can typically hold.

At large venues with many railed ends, guardrail removal contributes to a large part of the changeover time. Once each guardrail is removed from the ends of the platforms they need to be transported to a storage location. This removal and transporting of the guardrails prior to retracting the seating structures takes many man-hours. In addition, there is a need for a rather significant amount of space to store the guardrails. There is a need, therefore, for a system and method that eliminates the necessity of removing and transporting guardrails from the ends of a telescopic seating structure prior to retracting the structure's platforms.

SUMMARY OF THE INVENTION

The invention features a guardrail storage system for securing an end guardrail of a tier of a multi-tiered telescopic seating structure in a use position substantially parallel to an end of the tier, and in a storage position substantially parallel to a front beam (nose) of the tier, the system comprising a front bracket attached to a tier adjacent the front beam of the tier and configured to secure a guardrail to the tier, at least one locking mechanism to prevent relative motion between the front bracket and a guardrail secured in the front bracket, whereby, upon disengagement of the at least one locking mechanism, the guardrail is rotatable from its use position to its storage position, and wherein the front bracket rotationally secures the guardrail against the tier when in the storage position.

In one embodiment, the front bracket attached to the tier adjacent the front beam of the tier and is configured to secure a front leg of the guardrail to the tier, and the guardrail storage system further includes a rear bracket, attached to a rear beam of the tier, and configured for securing a rear leg of the guardrail to an end region of the tier proximate a rear beam of said tier.

In another embodiment of the invention, the invention features a method of transitioning a guardrail at an end of a tier of a telescopic multi-tiered seating system from one of an in-use position, wherein said guardrail is substantially parallel to an end of the tier, to a storage position wherein the guardrail is substantially parallel to a front beam of the tier prior to retracting the tiers of the seating system.

The method comprises the acts of disengaging a locking device that holds the guardrail in the in-use position and then pivoting the guardrail about a vertical axis of a front bracket attached to a tier adjacent the front beam of the tier and configured to secure a guardrail to the tier in a storage position. Finally, the method includes the act of securing the guardrail in the storage position.

The summary here is not an exhaustive listing of the novel features described herein, and are not limiting of the claims. These and other features are described in greater detail below.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 3A:
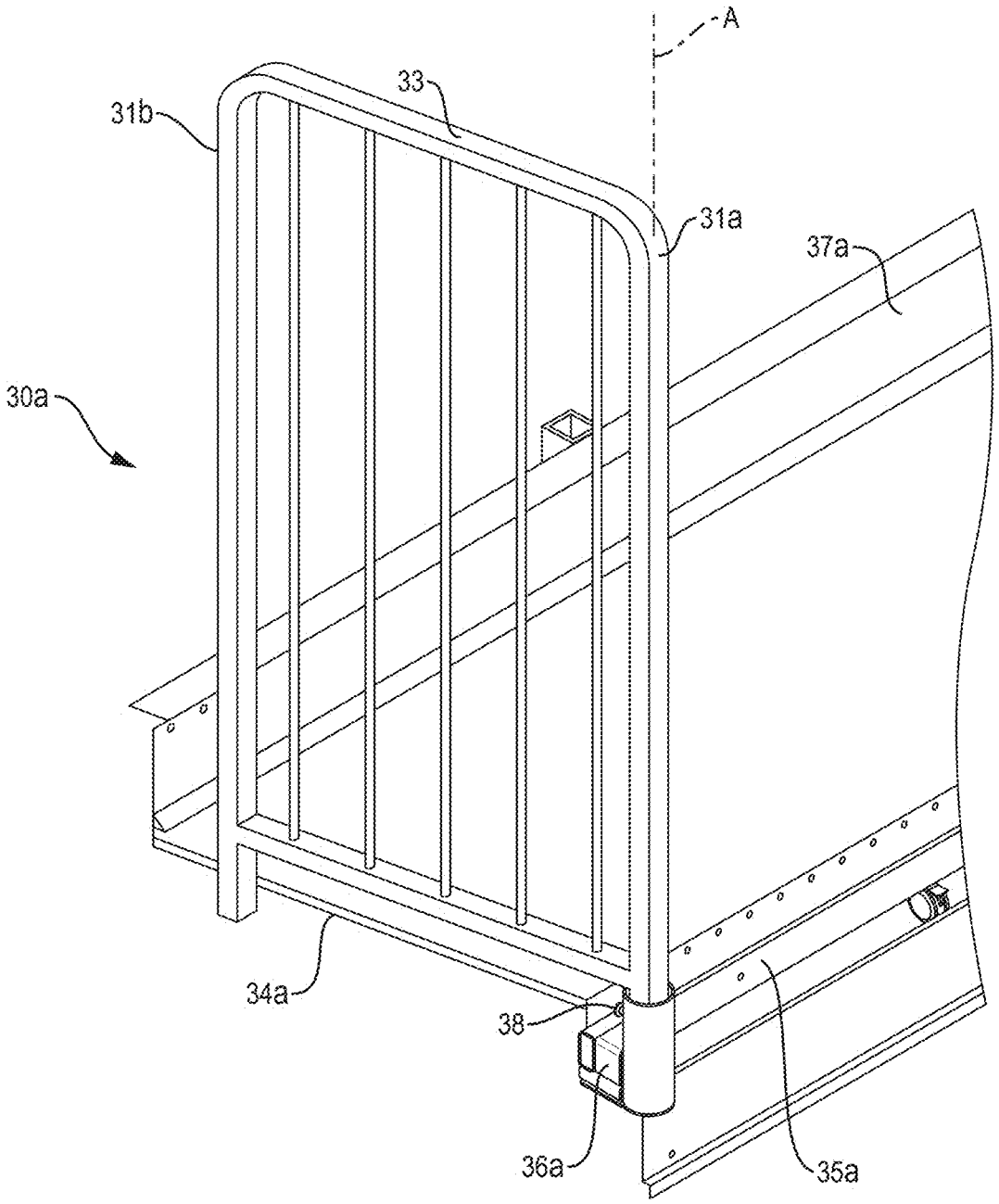
FIG. 3A is an isometric view of a guardrail held in a use position by only a front bracket.

FIG. 3A shows a first example of a guardrail system according to one embodiment of the present disclosure, wherein a representative tier 30*a* of a multi-tiered retractable seating system includes a guardrail 33 with a front leg 31*a* selectively secured to an end 34*a* of the tier 30*a* by a front socket 36*a* that is proximate the front beam 35*a* (the nose) of the tier.

Front socket 36*a* includes a locking mechanism that locks the guardrail 33 in place, preventing vertical movement of the guardrail 33 along axis A, and also prevents rotational movement about axis A. The example of FIG. 3A shows a guardrail 33 that is secured to the tier 30*a* only at its front leg 31*a*, which in some embodiments is sufficient to function as an effective barrier.

Figure 3B:
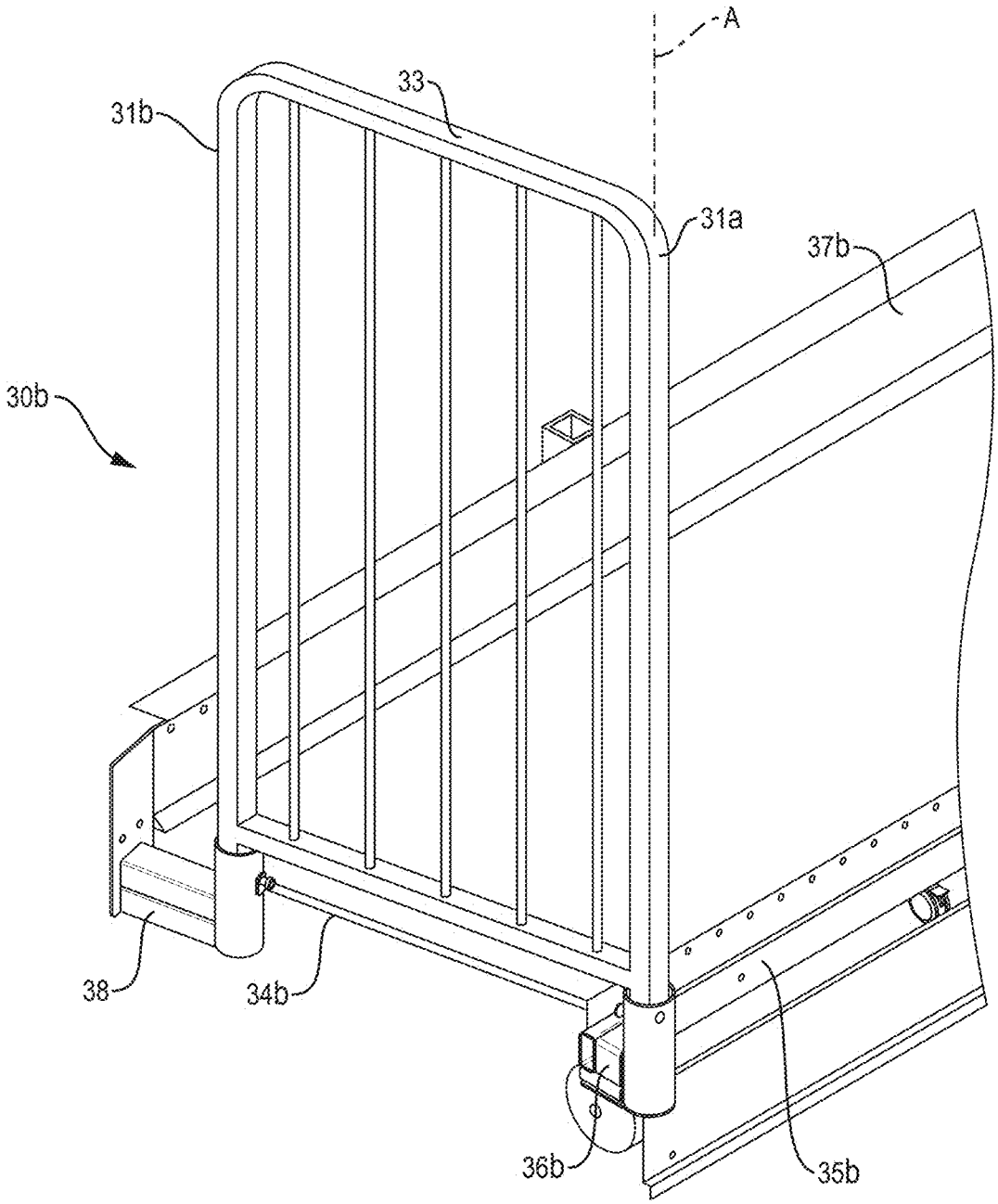
FIG. 3B is an isometric view of a guardrail held in a use position by both a front bracket and rear bracket.

FIG. 3B shows an example of a guardrail system with guardrail 33 having a front leg 31*a* and a rear leg 31*b*, where the front leg 31*a* is selectively secured to front socket 36*b* as with the example of FIG. 3A, and the rear leg 31*b* is selectively secured to a rear socket 38. The rear socket 38 secures the rear leg 31*b* of guardrail 33 to the end 34*b* of the tier 30*b* proximate the rear beam 37*b* of the tier 30*b* (the riser). The inclusion of the rear socket 38 holds the guardrail more securely than using just the front socket 36 when the size, shape and/or weight of the guardrail 33 or robustness of the sockets demand.

Figure 4:
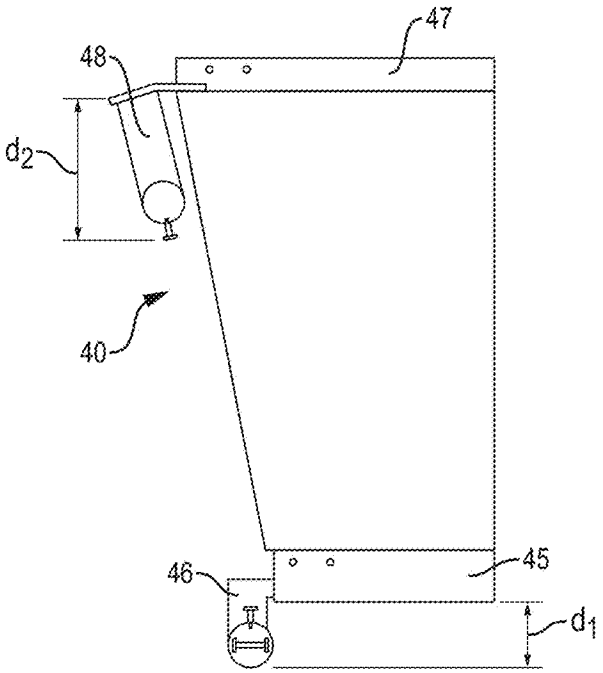
FIG. 4 is a top view of front and rear brackets mounted on a single tier of a seating structure.

In some embodiments, the front socket 46, FIG. 4, extends beyond the front face of front beam 45 by a distance d1. This distance d1 is chosen such that a guardrail can be secured in the front socket 46 in a position along the front beam 45 of the tier 40 without interfering with adjacent tiers of the seating structure when in a closed configuration (see FIG. 17).

Figure 5:
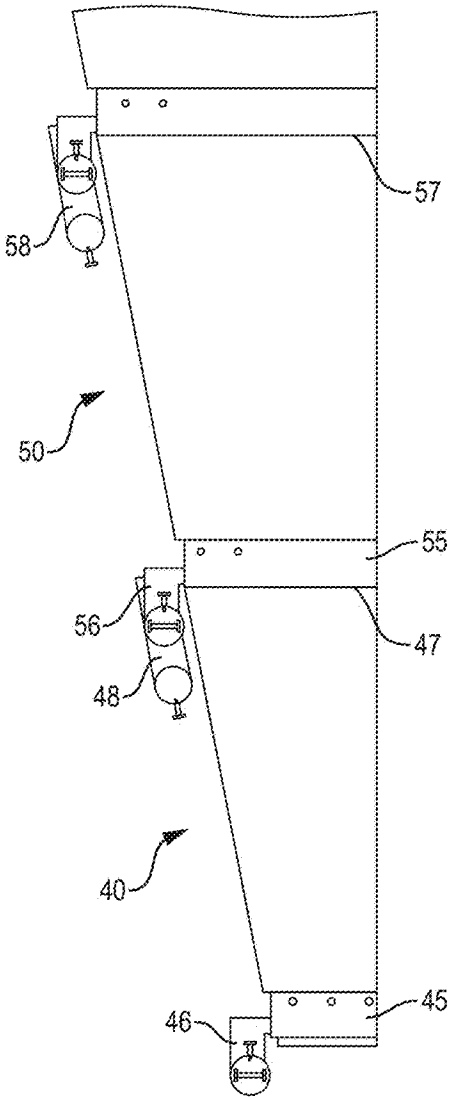
FIG. 5 is a top view of multiple adjacent tiers as shown in FIG. 4.
Figure 6:
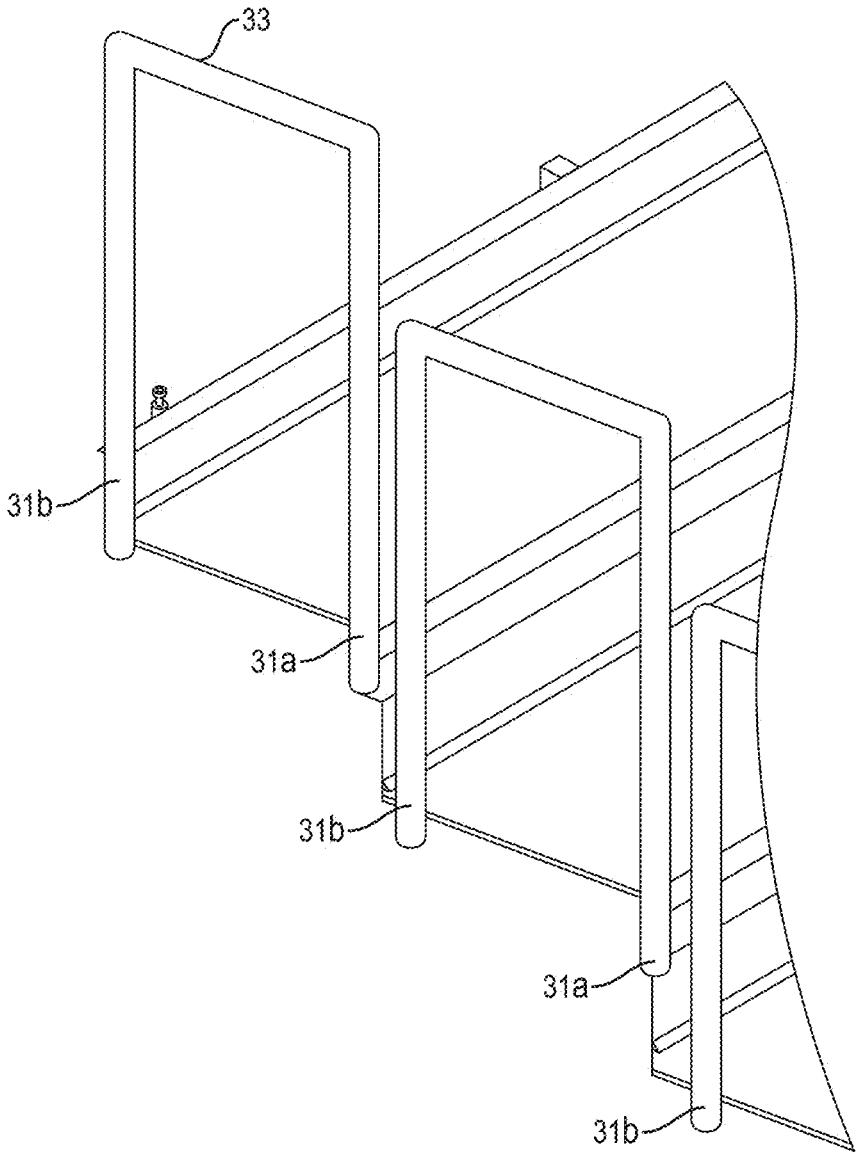
FIG. 6 is an isometric view of multiple adjacent tiers of a telescopic seating structure in an extended configuration with guardrails mounted on several tiers in a use or deployed position.

In some embodiments (also shown in FIG. 4) the rear socket 48 extends a distance d2 in front of back beam 47 toward the front beam 45 to provide clearance to the front socket 56 of a tier above (as shown in FIG. 5). When a bank of tiers in a seating structure is extended to an open position, as partially shown in FIG. 5, a first tier 40 having a front socket 46 and rear socket 48 is positioned such that its rear socket 48 is forward of the front socket 56 of an adjacent higher tier 50. With this example configuration a rear leg 31*b* of a guardrail 33 secured in a rear socket of a tier would not interfere with the front leg 31*a* of a guardrail 33 installed in the front socket of the above adjacent tier (See FIG. 6).

Figure 7A:
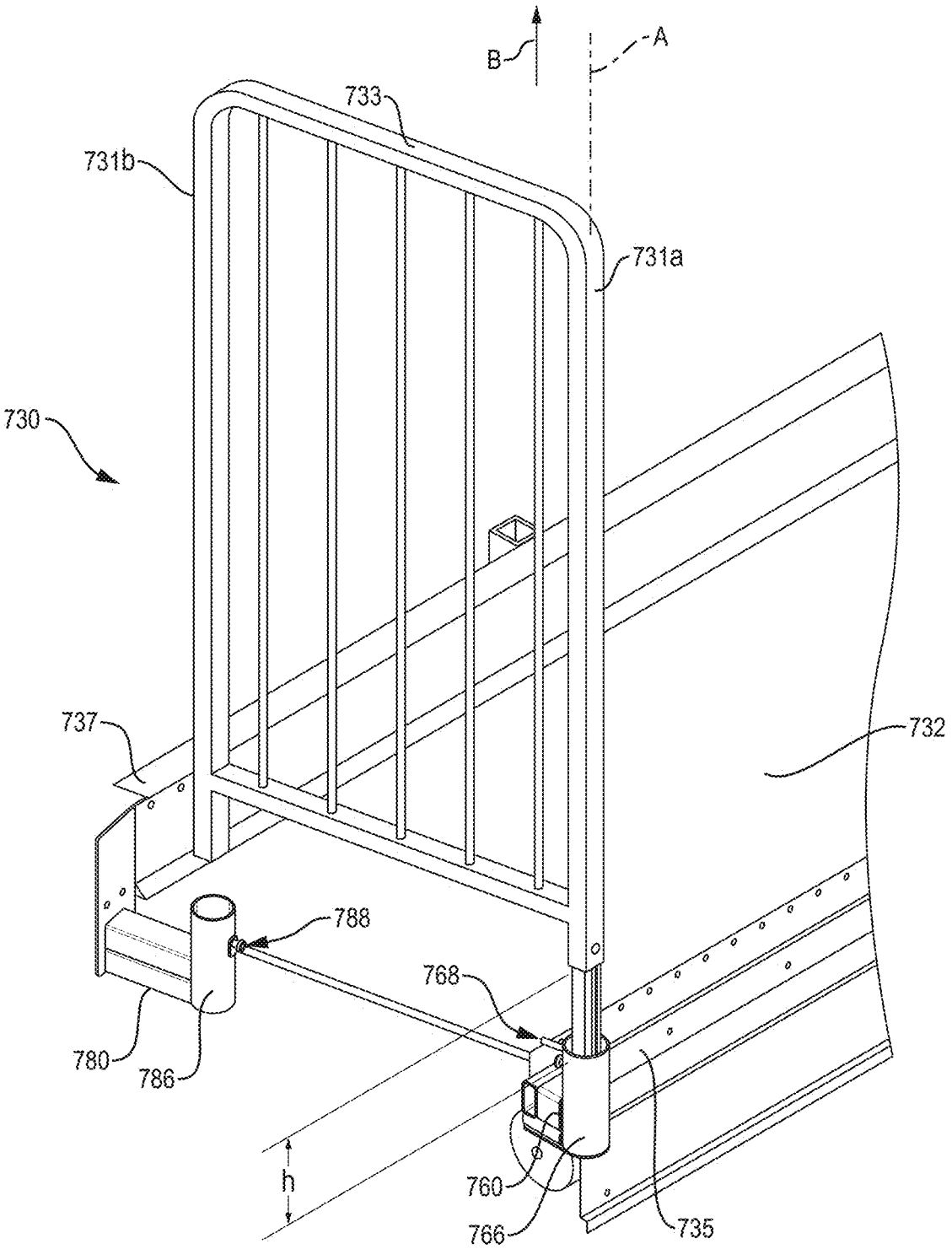
FIGS. 7A-7D, collectively referred to as FIG. 7, show a guardrail in multiple positions between a use position and a storage position.
Figure 7B:
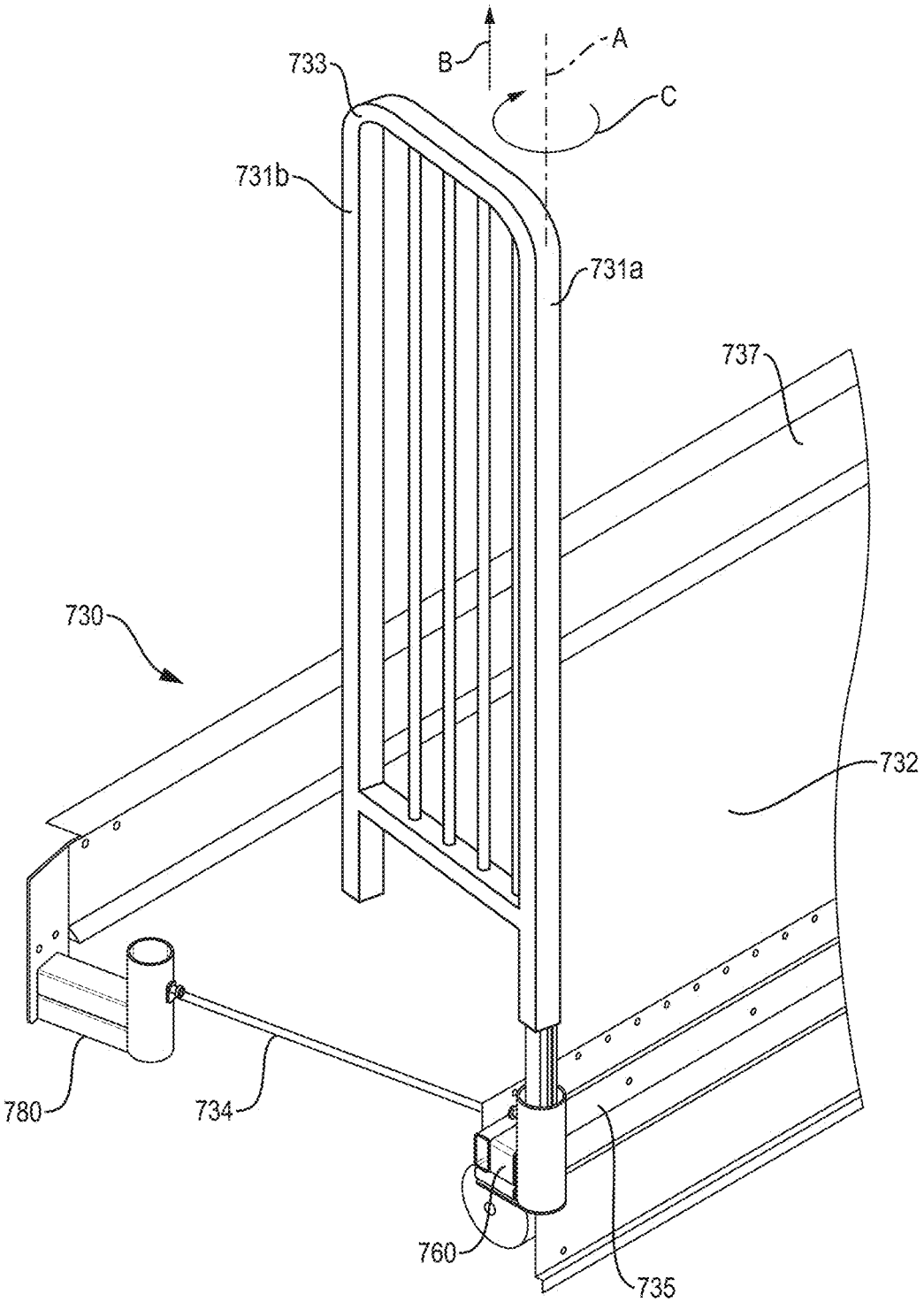
Figure 7C:
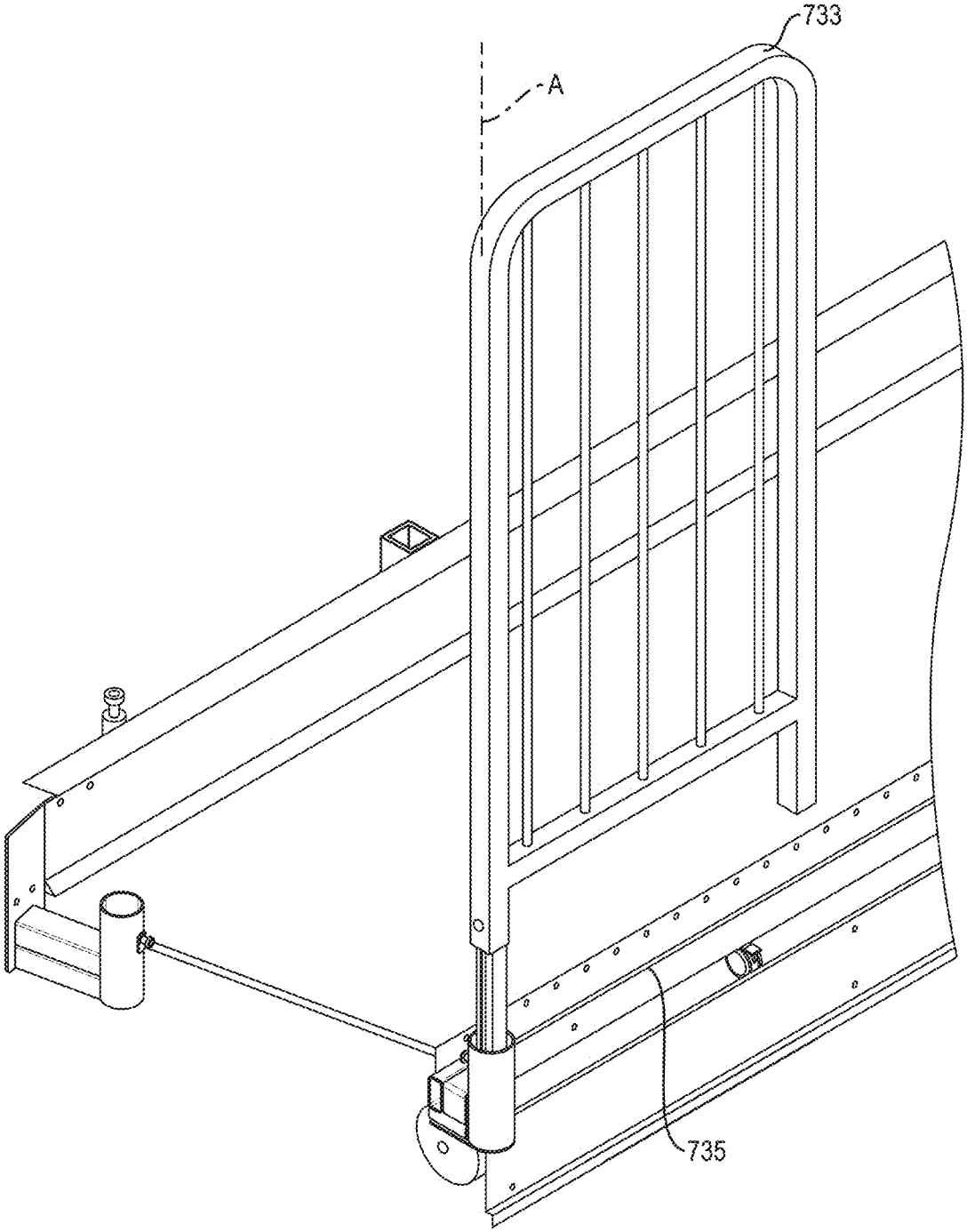
Figure 7D:
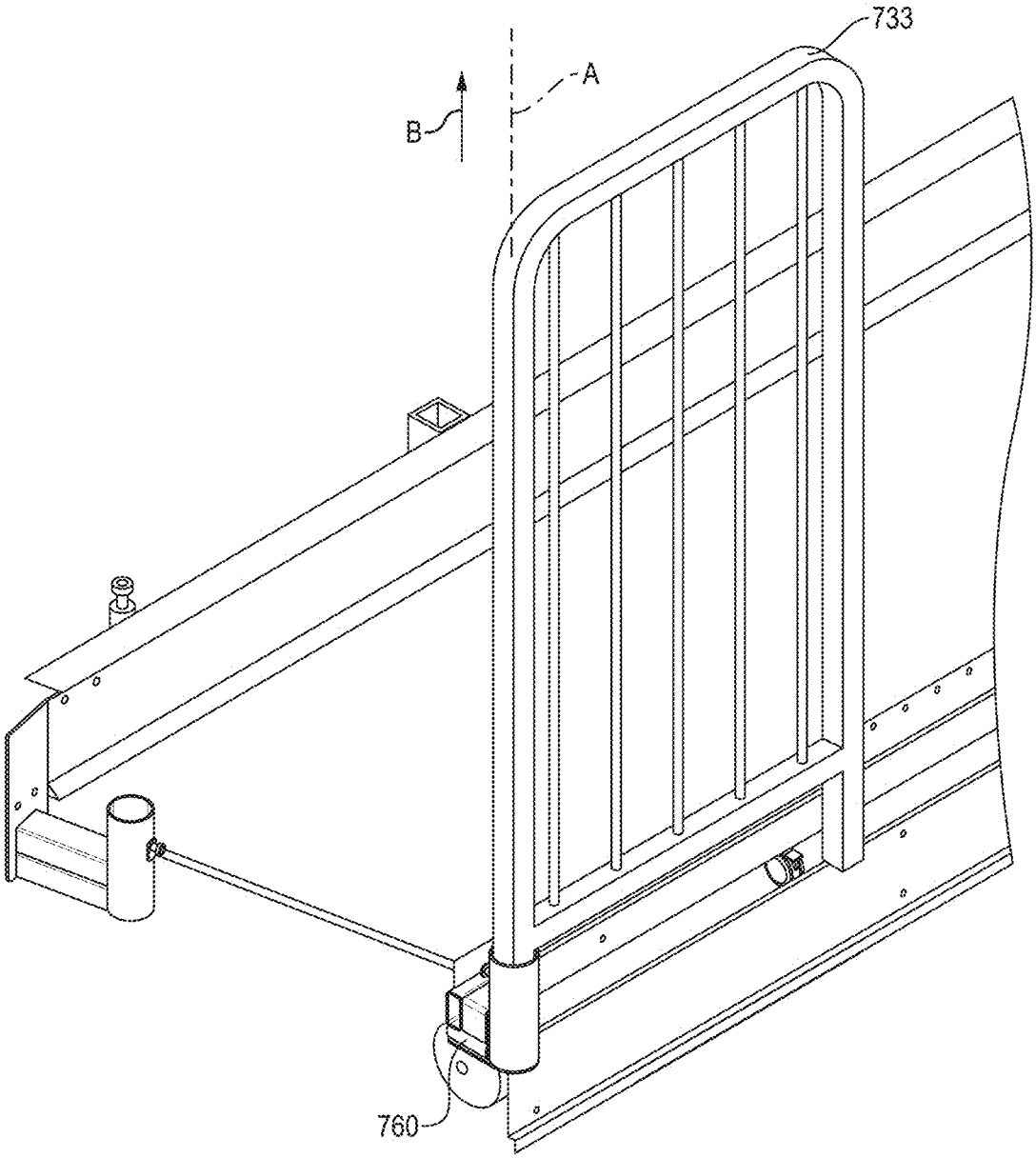

FIGS. 7A-7D illustrate an example of the operation of 0 and method to move a guardrail from an in-use configuration as shown in FIG. 3A or 3B, to a stored position such as that shown in FIG. 7D. To accomplish this, any engaged locking mechanism securing the guardrail 733 to the tier 730 must be disengaged. In some embodiments, the locking mechanism includes the front locking mechanism 768 of socket 760. In some embodiments, the locking mechanism also or further includes the rear locking mechanism 788 of rear socket 780. In other embodiments a manuakky operated to automatically locking latch, chain, pin, screw, or other fastener can act on the guardrail to prevent motion. Once the locking mechanism is disengaged, the guardrail 733 is free to move and rotate about axis!.

In some embodiments, once free to move, the guardrail 733 can simply be swung around about axis A away from end 734 of tier 730 to rest against the front beam 735. In other embodiments, the guardrail 733 is only free to move upwards while still being constrained from being rotated, such as when rear leg 31*b* is within rear socket 780 (as in FIG. 3B) [or other mechanism in the front socket 760 is engaged]. Once lifted a height h (FIG. 7A), the guardrail 733 is free to rotate around axis A. While FIG. 7B shows the guardrail 733 rotated inwards towards the tier 730 (clockwise in direction C on the end of the tier 730), in some embodiments the guardrail 733 is first rotated away from the tier (opposite direction C), such as when the platform 732 of tier 730 includes elements such as chairs or benches that impede rotation into the tier.

Once in a position where the guardrail has been rotated about axis A to be substantially parallel to the front beam 735 (FIG. 7C), the guardrail is lowered along axis A in a direction opposite direction B to a storage position (FIG. 7D). In some embodiments, a storage position locking mechanism is engaged to prevent rotation of the guardrail 733 around axis A. In some embodiments a storage position locking mechanism is engaged to prevent vertical motion of the guardrail 733 along axis A.

Figure 8:
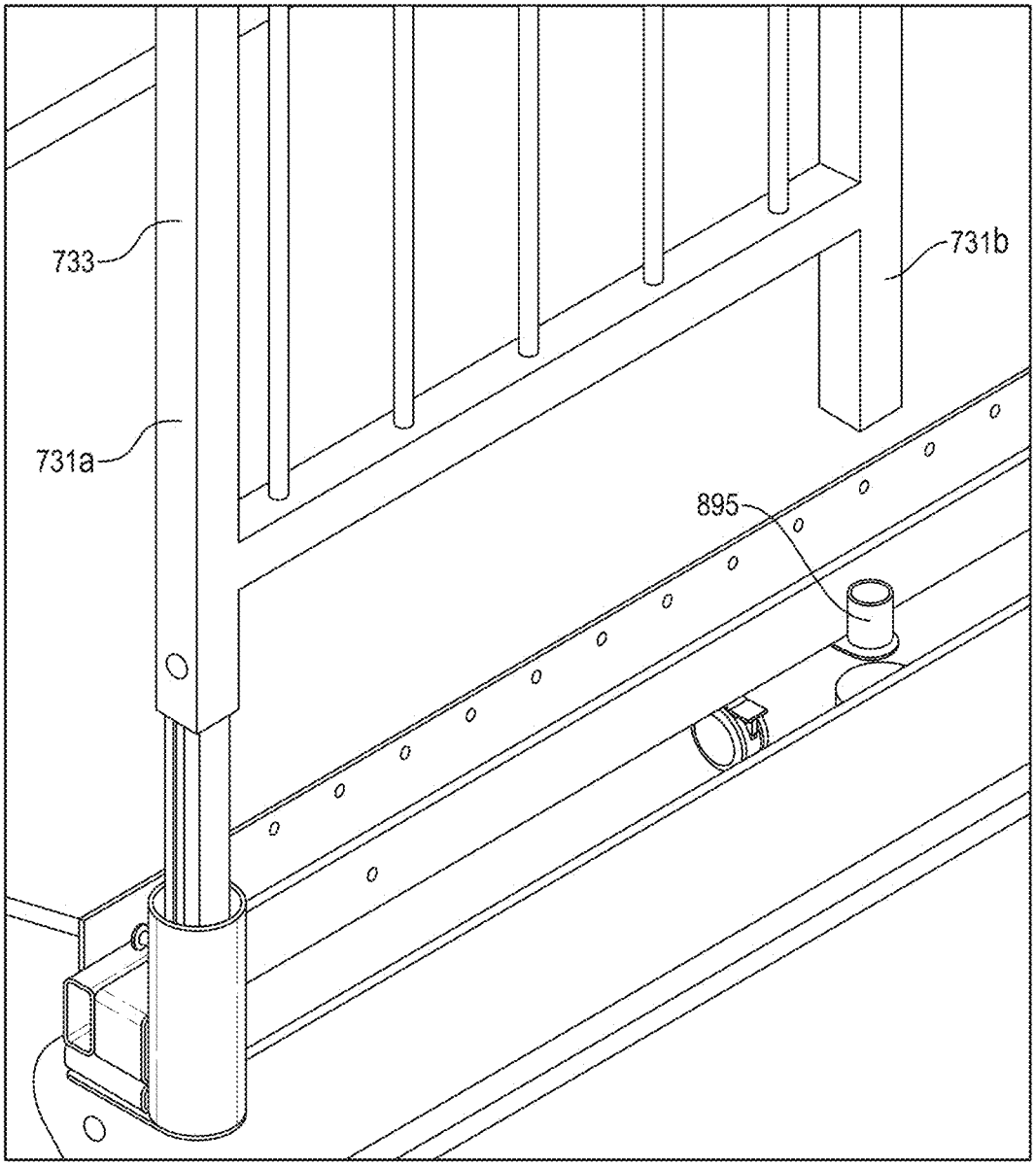
FIG. 8 is a close-up isometric view showing one exemplary locking mechanism of the guardrail storage system according to one embodiment of the present invention.
Figure 9A:
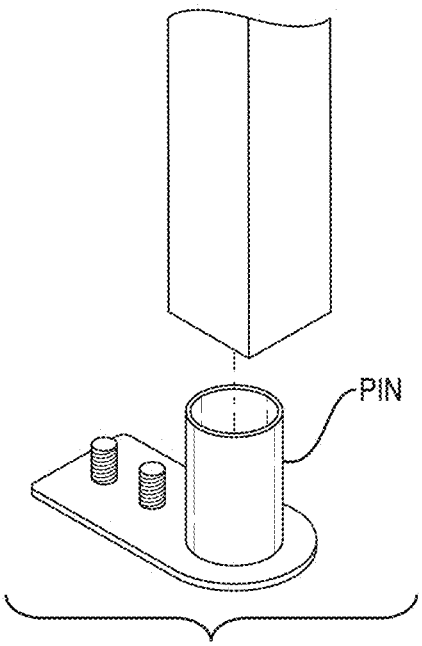
FIGS. 9A-9C show various example locking mechanisms.
Figure 9B:
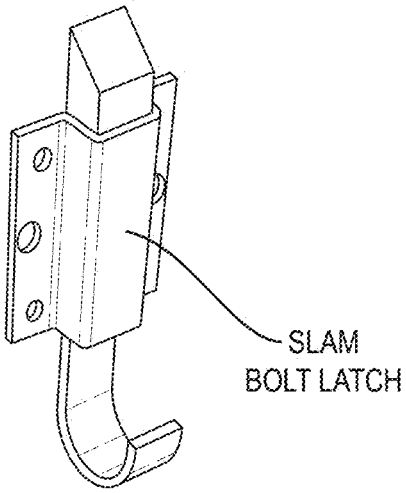
Figure 9C:
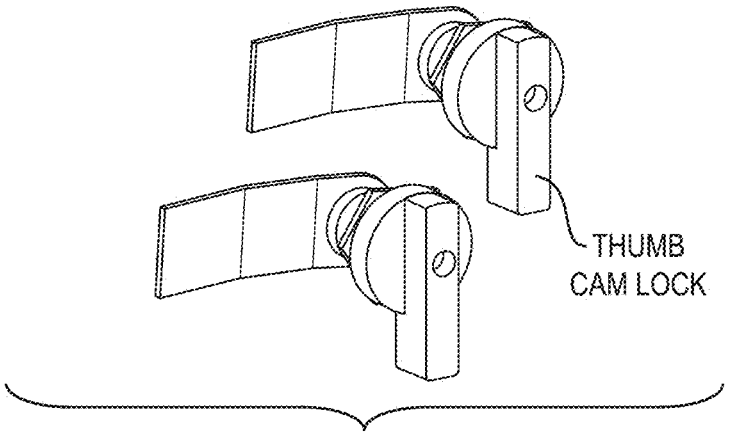

FIG. 8 shows guardrail 730 over a storage position locking mechanism 895 that is configured to engage the rear leg 731*b* of the guardrail 733 to prevent rotation of the guardrail 733. FIGS. 9A-9C show various embodiments of locking mechanisms, such as a pin that engages an opening at the bottom of rear leg 731*b*, a slam bolt latch, or thumb cam lock, to name a few.

Figure 1A:
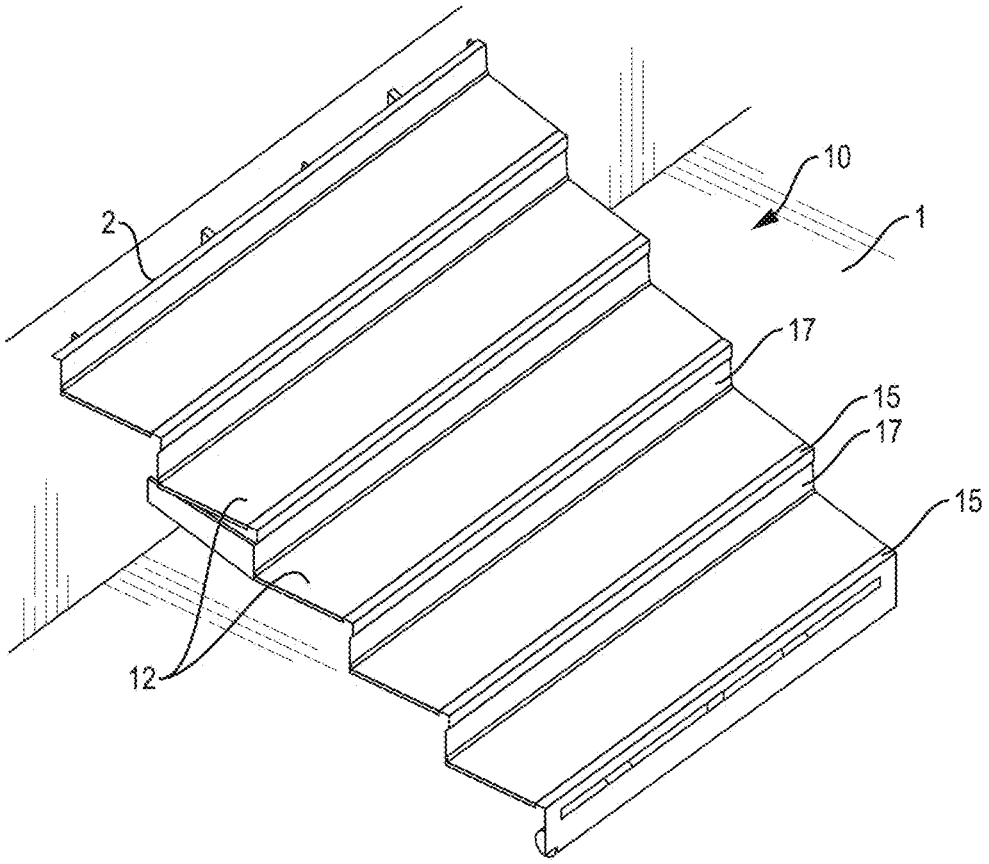
FIGS. 1A and 1B, collectively referred to as FIG. 1, are isometric views of a telescopic seating structure having one tapered side and one straight side in both extended (FIG. 1A) and closed (FIG. 1B) configurations, as known in the art.
Figure 1B:
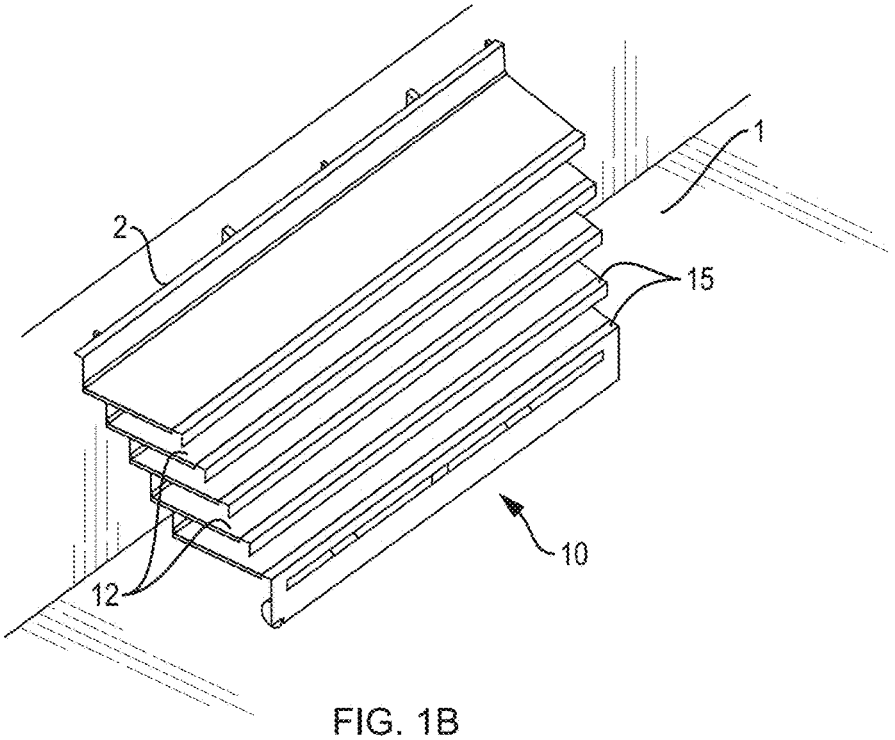
Figure 2A:
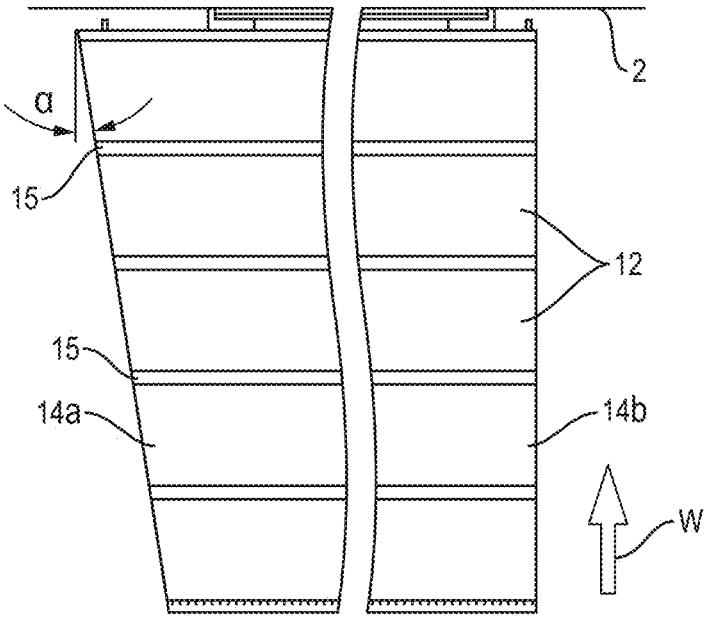
FIGS. 2A and 2B, collectively referred to as FIG. 2, are top views of the telescopic seating structure of FIG. 1 in both extended (FIG. 2A) and closed (FIG. 2B) configurations.
Figure 2B:
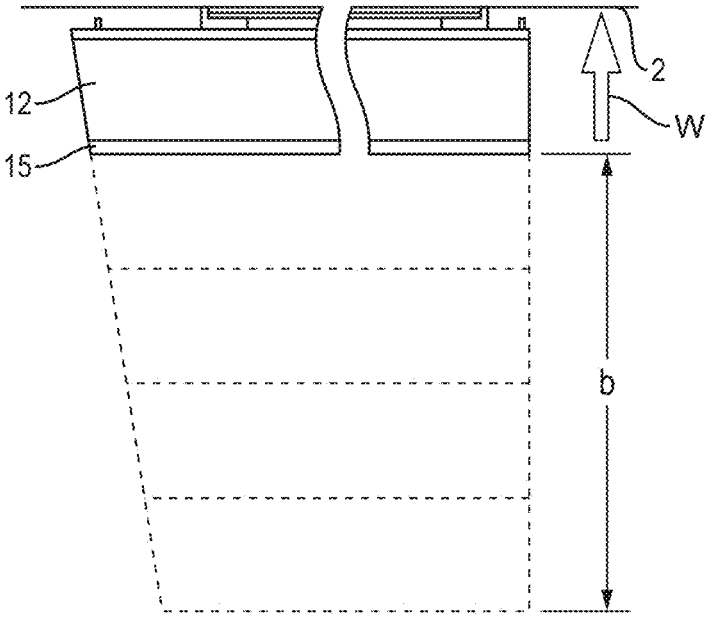
Figure 10:
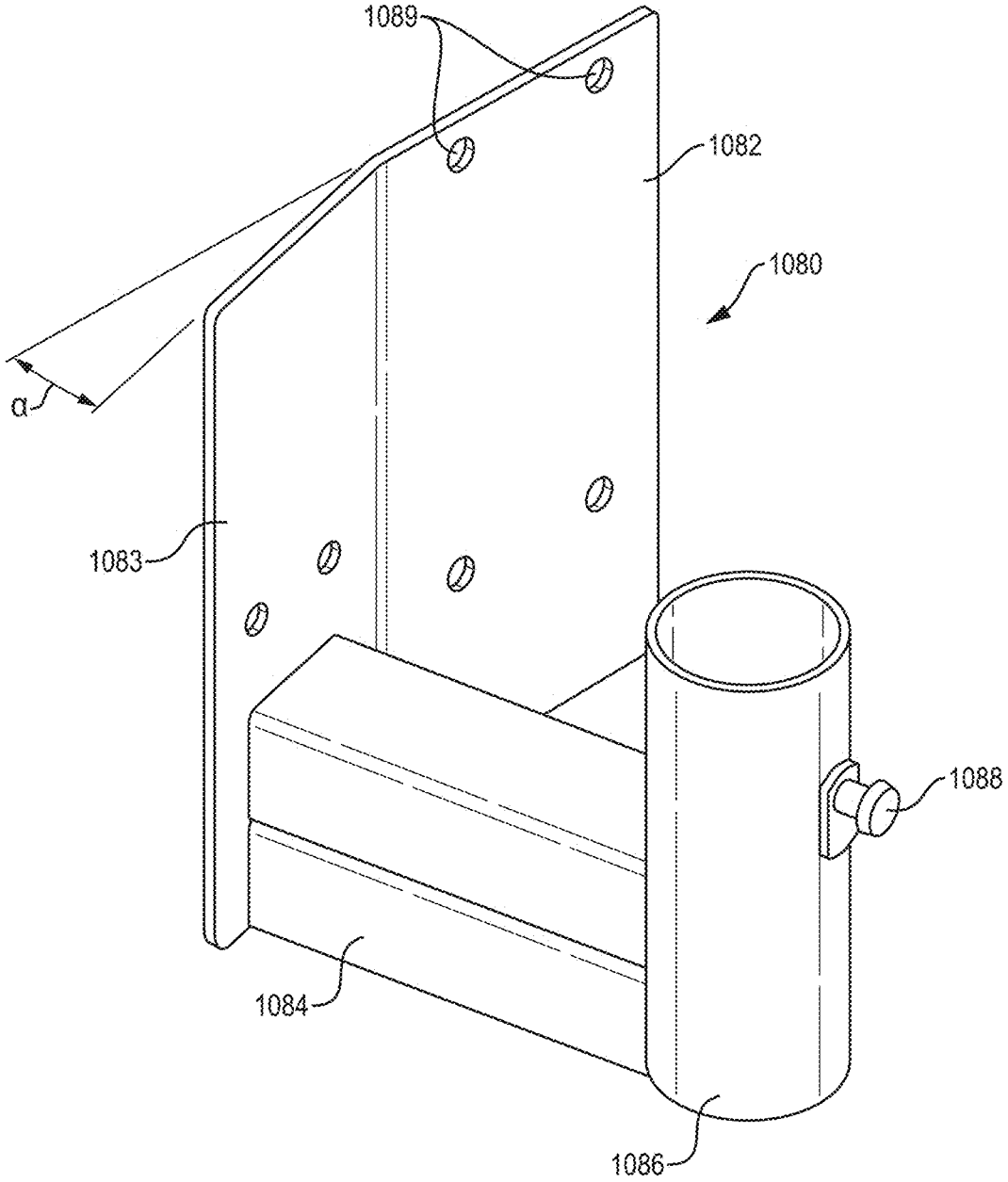
FIG. 10 is an isometric view of a rear bracket.

FIG. 10 shows an example of rear socket 1080. Rear socket 1080 includes a rear socket arm 1084 that connects a rear receiver 1086 to mounting plate 1082. Mounting plate 1082 secures the rear socket 1080 to the rear beam of a tier at securing locations 1089. In some embodiments for tiers with tapered ends, mounting plate 1082 may include a bent portion 1083 to angle the rear bracket arm 1084 an angle *alpha* to be parallel to the end of a tapered tier (see FIG. 2A). Alternatively mounting plate 1082 can remain flat and rear socket arm 1084 can be angled with respect to the mounting plate 1082. Rear receiver 1086 in some embodiments includes locking mechanism 1088, such as a bolt or set screw that is tightened against a rear leg of a guardrail inserted into the rear receiver 1086.

Figure 11:
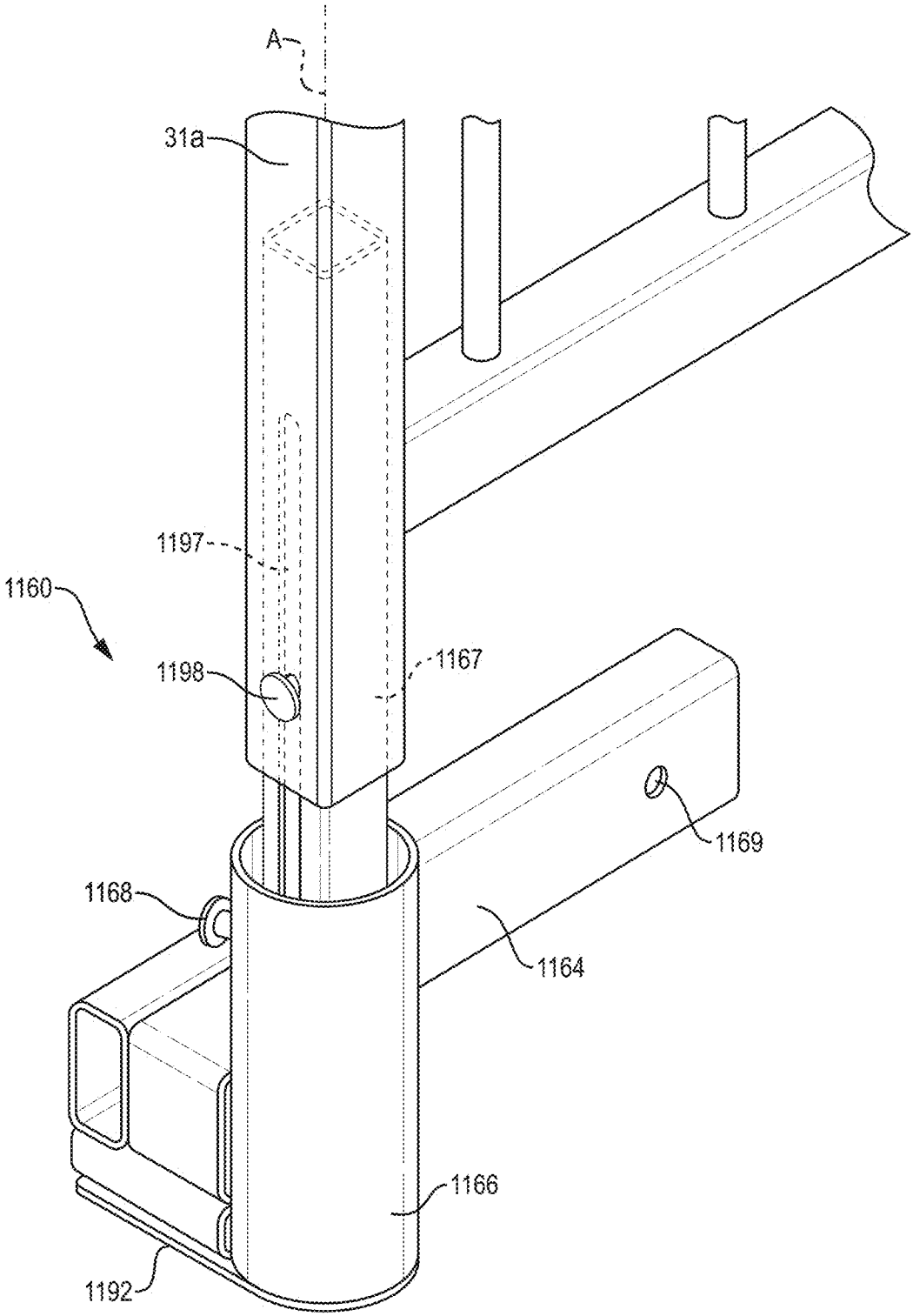
FIG. 11 is an isometric view of a front bracket with a first set of details visible.

FIG. 11 shows an example front socket 1160 having a front receiver 1166 and front socket arm 1164 that secures the front socket 1160 to a front beam of a tier. Front receiver 1166 is rigidly attached (such as by welding or unitary construction) bottom plate 1192, which is fastened to the front socket arm 1164 via securing members 1193 (as seen more clearly in FIG. 12). Front bracket 1160 further includes post 1167 onto which front leg 31*a* is slidably secured. Post 1167 includes a slot 1197 along which a fastener 1198 that passes through the front leg 31*a* slides to keep the front leg 31*a* attached to the post 1167 while allowing relative motion therebetween in the longitudinal direction of axis A.

Figure 13:
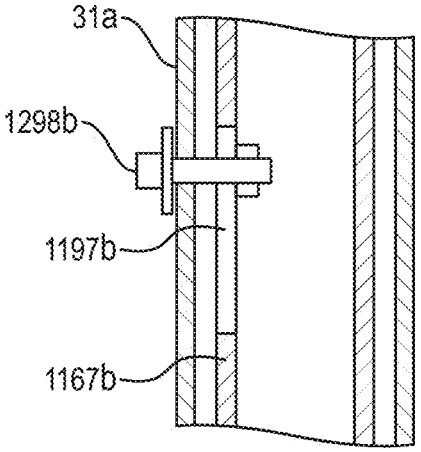
FIG. 13 is a cross-sectional view of a slotted portion of the front bracket visible in FIG. 12.

In some embodiments, the post 1167 is a hollow extrusion with a single slot 1197 going through a wall thereof, with a slot follower 1198 extending through the front leg 31*a* and slot 1197 to a mating threaded insert within the post 1167 that can be tightened to secure the front leg 31*a* to the post 1167, either slidingly or frictionally fixed (FIG. 13). In some examples or embodiments, opposing slots 1197 extend through opposing walls of the post 1167 and slot follower 1198 extends through the front leg 31*a* and both slots 1197 as seen in FIG. 14.

Front receiver 1166 may further include a locking mechanism 1168, such as a bolt or set screw that is tightened against a front leg 31*a* inserted into the front receiver 1166 to prevent both rotation within and retraction from the front receiver 1166. In some embodiments, the slots and slot follower orientations are or may be reversed, with slots in the guardrail front leg 31*a* and the slot follower is at a fixed location on the post 1167.

Figure 12:
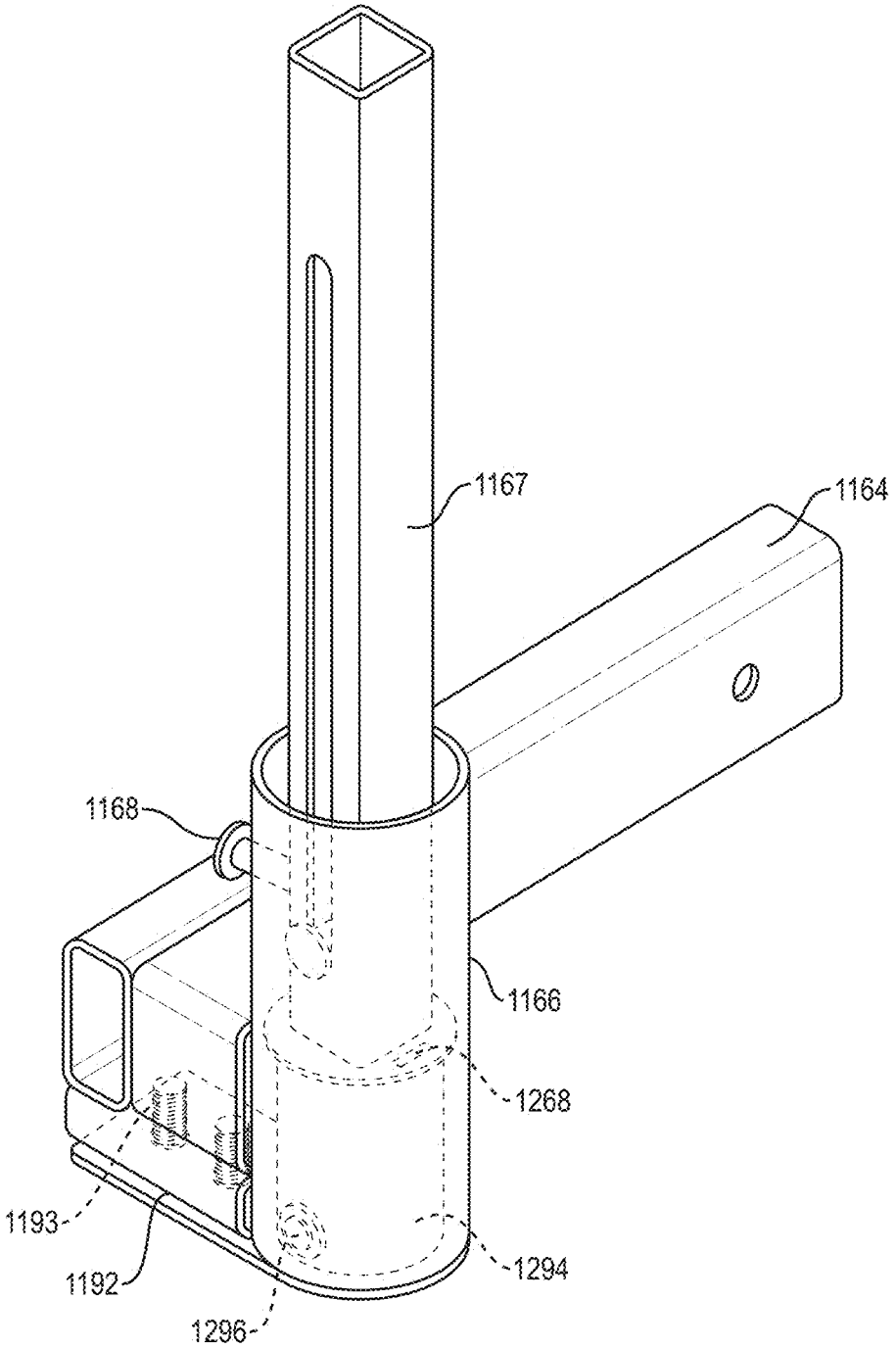
FIG. 12 is an isometric view of the front bracket with a second set of details visible.

FIG. 12 shows the example front socket of FIG. 11 with the front socket arm 1164, front receiver 1166, and locking mechanism 1168 in ghost, showing the securing members 1193, and features of the post 1167. In some embodiments post 1167 includes an alignment plate 1268 to keep the post 1167 centered in the front receiver 1166. In some examples or embodiments, there are two or more alignment plates 1268 to provide alignment at multiple points within the front receiver 1166 the post 1167 includes a pivot register 1294 that pivots on bottom plate 1192. In some examples or embodiments, pivot register 1294 includes a registration member 1296, such as a pin or bolt that extends across the pivot register as more clearly seen in FIG. 14.

Figure 14:
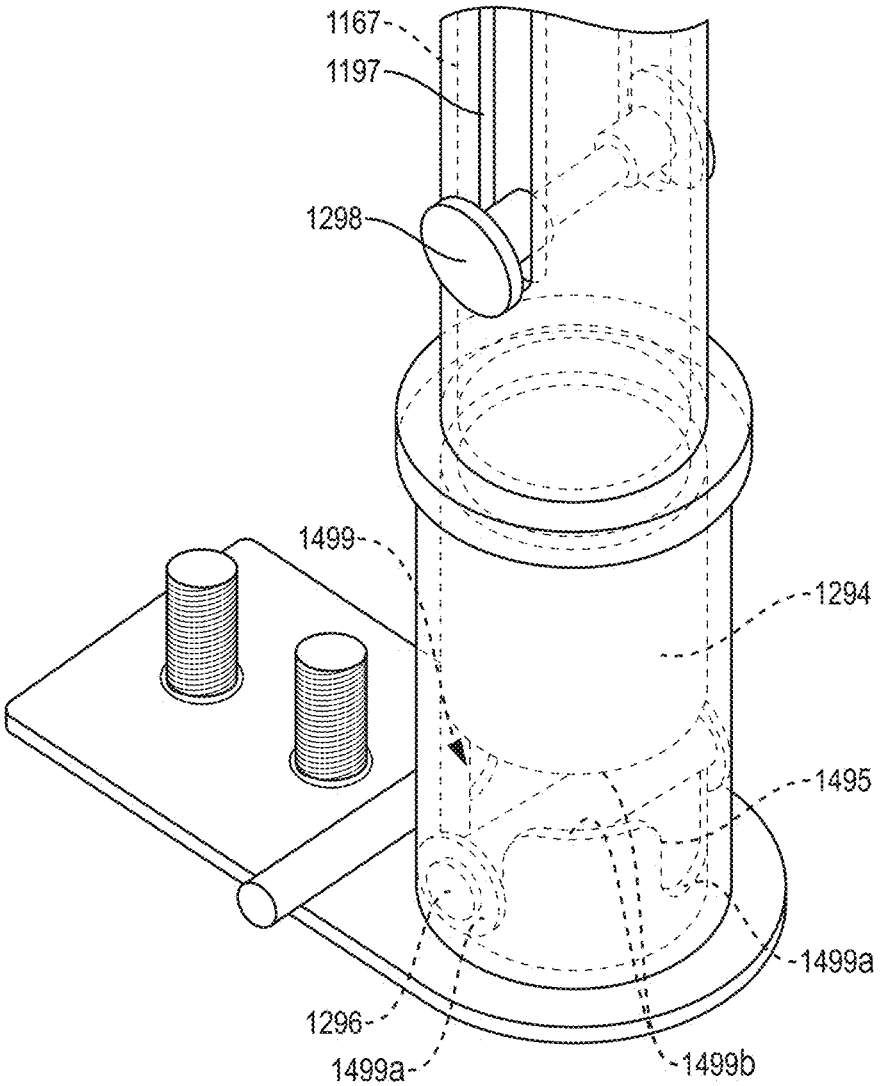
FIG. 14 is an isometric view of additional details of the front bracket a FIG. 11.

FIG. 14 shows the post 1167 in in phantom except for registration member 1296. Registration member 1296 cooperates with a cam structure 1495 having registration locations 1499*a* where registration member 1296 settles to rotationally register the post 1167 in predetermined positions, including an in-use position such as that shown in FIG. 3A and a storage position such as that shown in FIG. 7D. In some embodiments, the cooperation of the pivot register 1294 and cam structure 1495 obviates the need for a rear socket 1080 or locking mechanism 1168 as pivot prevention structures, although their use may still be valuable to provide additional guardrail support.

In some embodiments, rear socket 1180 prevents rotation of the guardrail when engaged with the rear leg 31*b* of guardrail 33, obviating the need for a registration member 1296 and cam structure 1495 to lock the guardrail in in-use and storage positions. In the example where the rear socket 1180 includes a rear receiver 1086 into which the rear leg 31*b* is inserted, slot follower 1198 extends through the front leg and into the slot 1197 in a slidingly secure manner (that is, secured from removal from the slot while allowing movement therealong). In some embodiments, such as that shown in FIG. 13, the slot follower 1198*b* extends into a single slot 1197*b* on post 1167*b* in a slidingly secure manner. In some embodiments, such as that shown in FIG. 14, the slot follower 1198*a* is a through bolt that extends through two slots 1197 on opposing sides of post 1167 and is secured on both ends to front leg 31*a*. In such scenarios, the guardrail 33 must be lifted such the slot follower 1198 travels to the topmost part of the slot(s) 1197 before the post 1167 and attached registration member 1296 are lifted out of a registration position 1499*a* and allowed to rotate. The distance h (see FIG. 7A) that the slot follower 1198 must travel before hitting the top of the slot 1197 must be sufficient to remove the rear leg 31*b* from the rear receiver 1086 so it is clear to allow the registration member 1296 to rotate.

In some embodiments, such as when there is no rear socket to lift out of, slot follower 1198 can be fixed in place relative to post 1167 to prevent relative motion between the guardrail front leg 31*a* and the post 1167. In some embodiments this is accomplished by tightening the slot follower 1198 to frictionally secure the front leg 31*a* to the post 1167 (i.e. tightening the slot follower 1298*b* of FIG. 13 to pull the post 1167*b* against the front leg 31*a*, or tightening the slot follower 1298 of FIG. 14 to squeeze the post 1197 between opposing sides of front leg 31*a*). In this embodiment, the guardrail 33 only needs to be lifted enough to have the registration member 1296 rise out of a registration positions 1499*a* after which it can be rotated slightly and placed back down onto cam surface 1499*b* to bear the load of the guardrail 33 while rotating it to the next registration position 1499*a*.

In the embodiment shown in FIG. 14, cam surface 1499*b* includes the periphery of a slot 1499 within cam structure 1495 that provides both a lower cam surface to rest on and an upper cam surface that limits the upward motion of the registration member 1296 when the guardrail 33 is lifted in order to prevent the post 1167 from being removed from the front receiver 1166. In some embodiments, such as that of FIG. 12, locking mechanism 1168 extends into the front receiver 1166 such that alignment plate 1268 would be prevented from being removed from the front receiver 1166.

Figure 15:
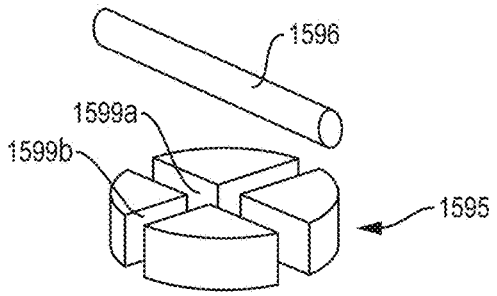
FIG. 15 is an isometric view of an alternative cam structure to the one shown in FIG. 14.

FIG. 15 provides another example of a cam structure 1595 having registration positions 1599*a* for aligning registration member 1596 and cam surfaces 1599*b* for the registration member to roll along while being rotated.

Figure 16A:
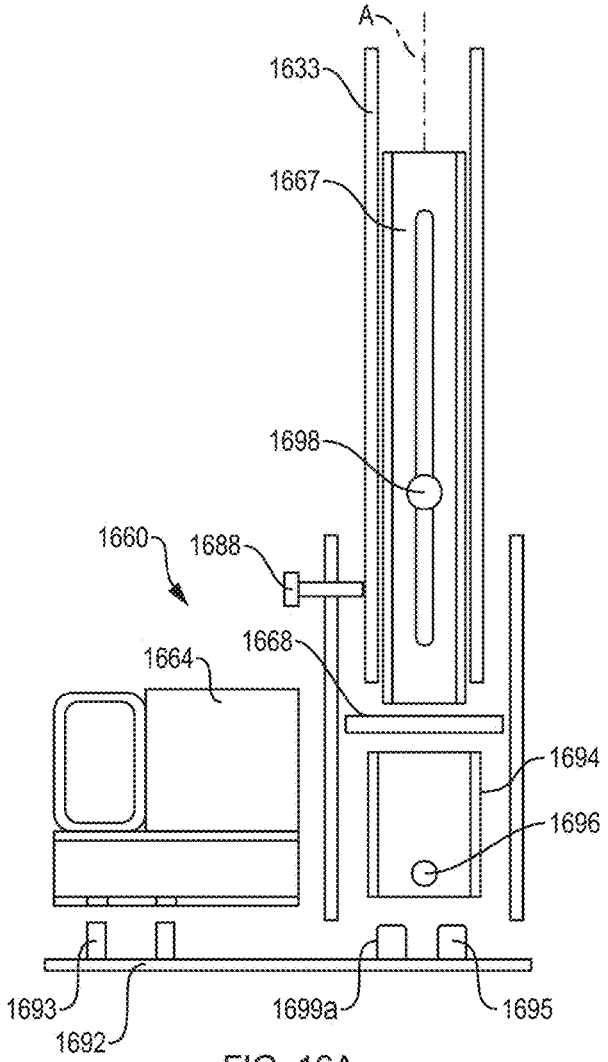
FIGS. 16A and 16B, collectively referred to as FIG. 16, show partially exploded views of a front bracket when a guardrail is in a storage position (FIG. 16A) and a use position (FIG. 16B)
Figure 16B:
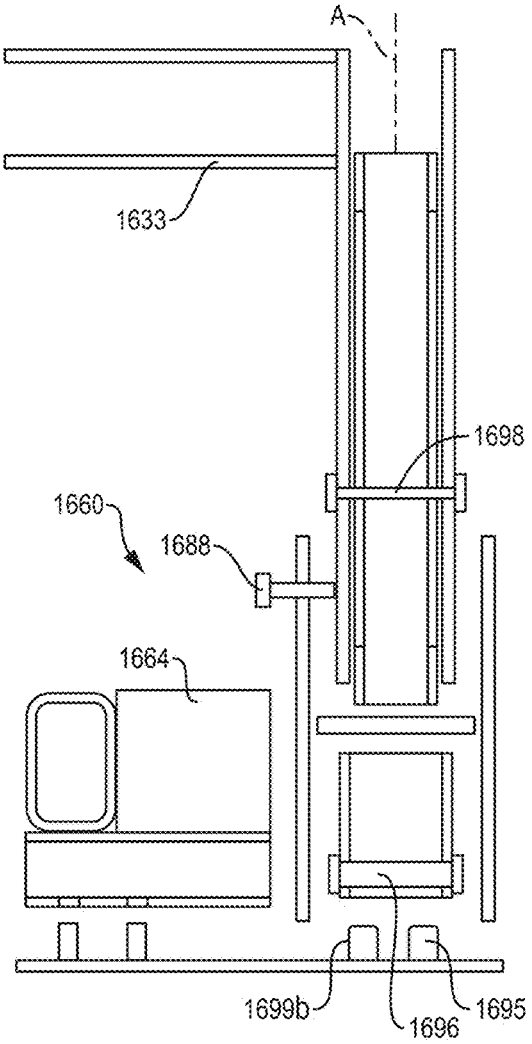

FIGS. 16A and 16B show a partially exploded view of a front socket 1660 with an attached guardrail in two positions. In FIG. 16A, the guardrail 1633 is substantially parallel to the longitudinal axis of the front socket arm 1664 (as in the position shown in FIG. 11), as are the slot follower 1698 and registration member 1696. Bottom plate 1692 has disposed thereon securing member 1693 and cam structure 1695, which in this example is similar to the cam structure 1595 of FIG. 15, having no upper cam surface to constrain the registration member 1696 in the vertical direction (along axis A).

In this embodiment locking member 1688 would impede the vertical movement of alignment plate 1668 (as well as the pivot register 1694 and the rest of attached post 1667). Cam structure 1695 has orthogonal slots as registration positions 1699*a*, with the registration member 1696 aligned with a first one of the slots in the position of FIG. 16A.

FIG. 16B shows the guardrail 1633 in a second position that is, along with slot follower 1698 and registration member 1696, substantially perpendicular to the longitudinal axis of the front socket arm 1664. In this position registration member 1696 is aligned with a second one of the orthogonal slots defining a second registration position 1699*b*.

Figure 17:
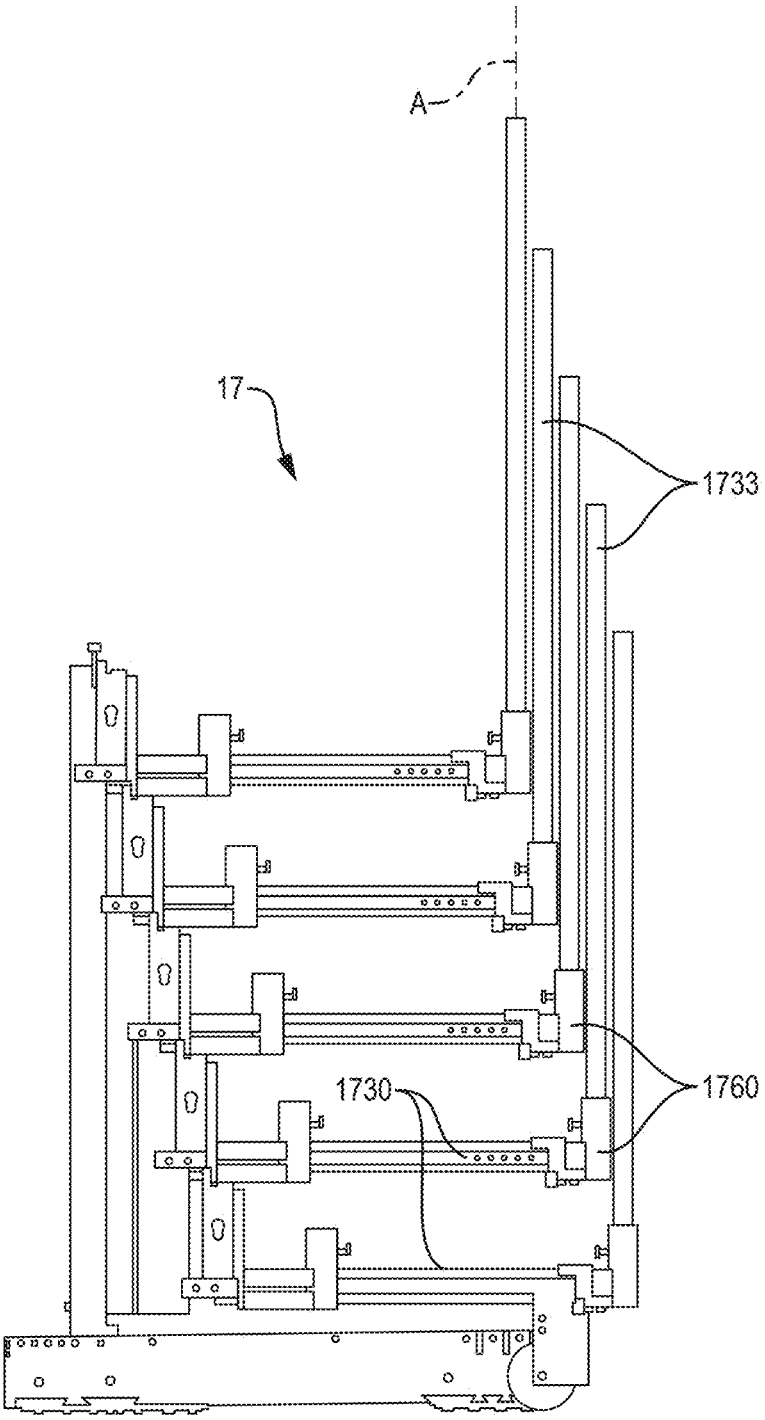
FIG. 17 is a side view of multiple tiers of a seating structure having guardrails in a vertical storage position.

When adjacent tiers of a seating structure are retracted with guardrails 1733 in vertical storage positions (parallel to axis A) along their respective front beams, lower tiers 1730 may be obstructed from moving to a fully retracted position (with the front sockets 1760 aligned vertically) due to contact between adjacent guardrails 1733, as in the guardrail system 17 of FIG. 17.

Figure 18A:
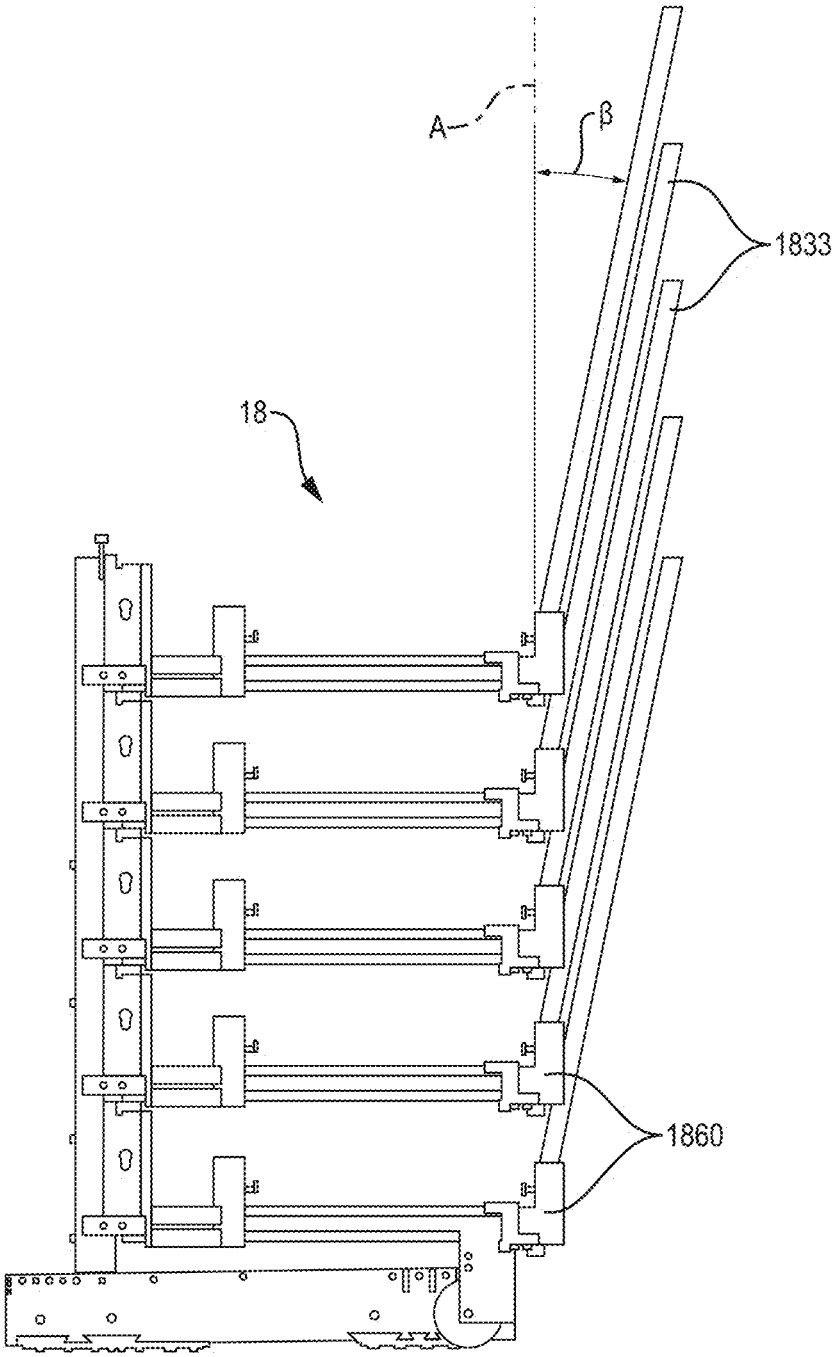
FIG. 18A is a side view of multiple tiers of a seating structure having guardrails in a tilted storage position.
Figure 18B:
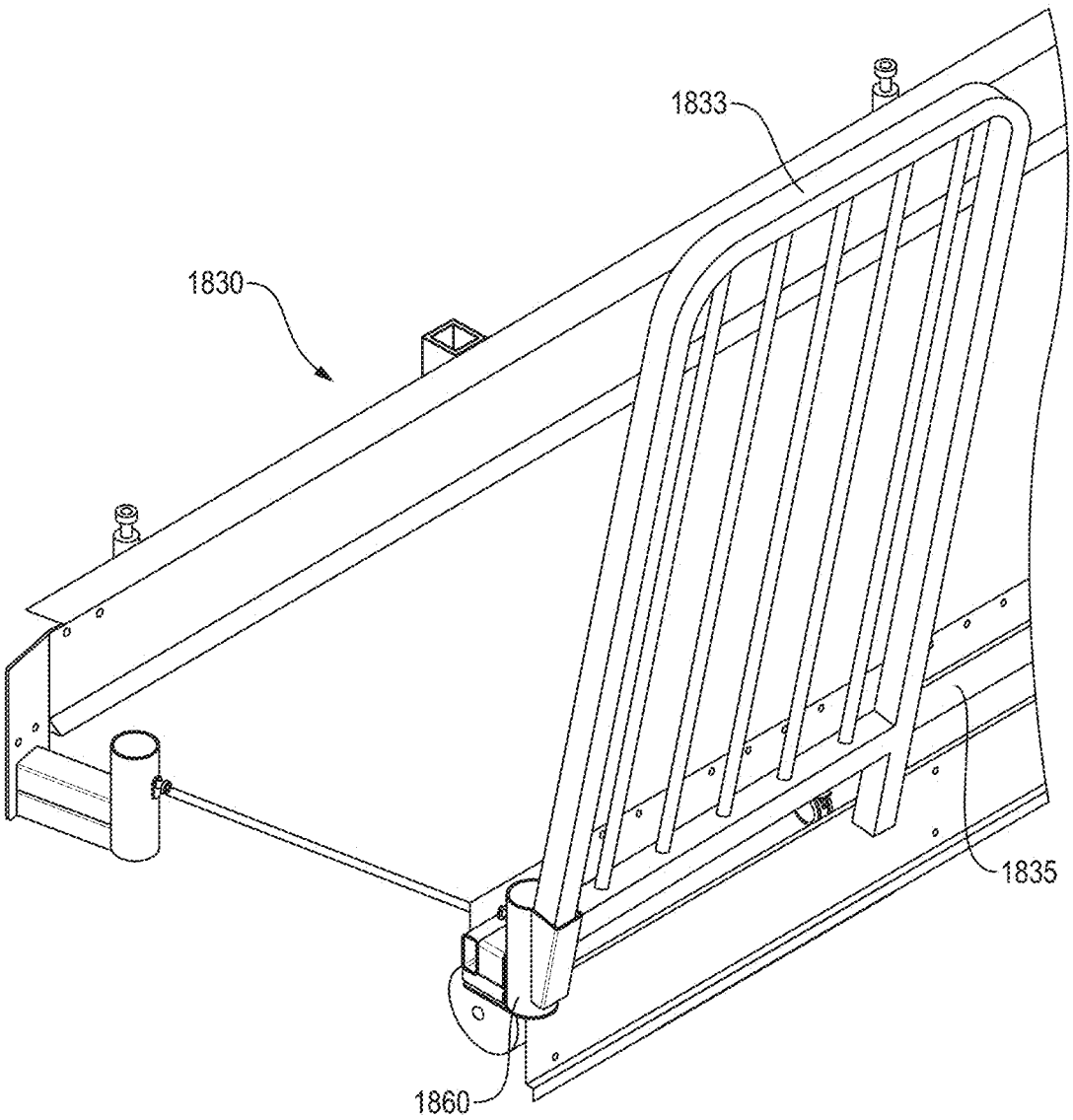
FIG. 18B is an isometric view of the guardrail storage system of FIG. 18.
Figure 19:
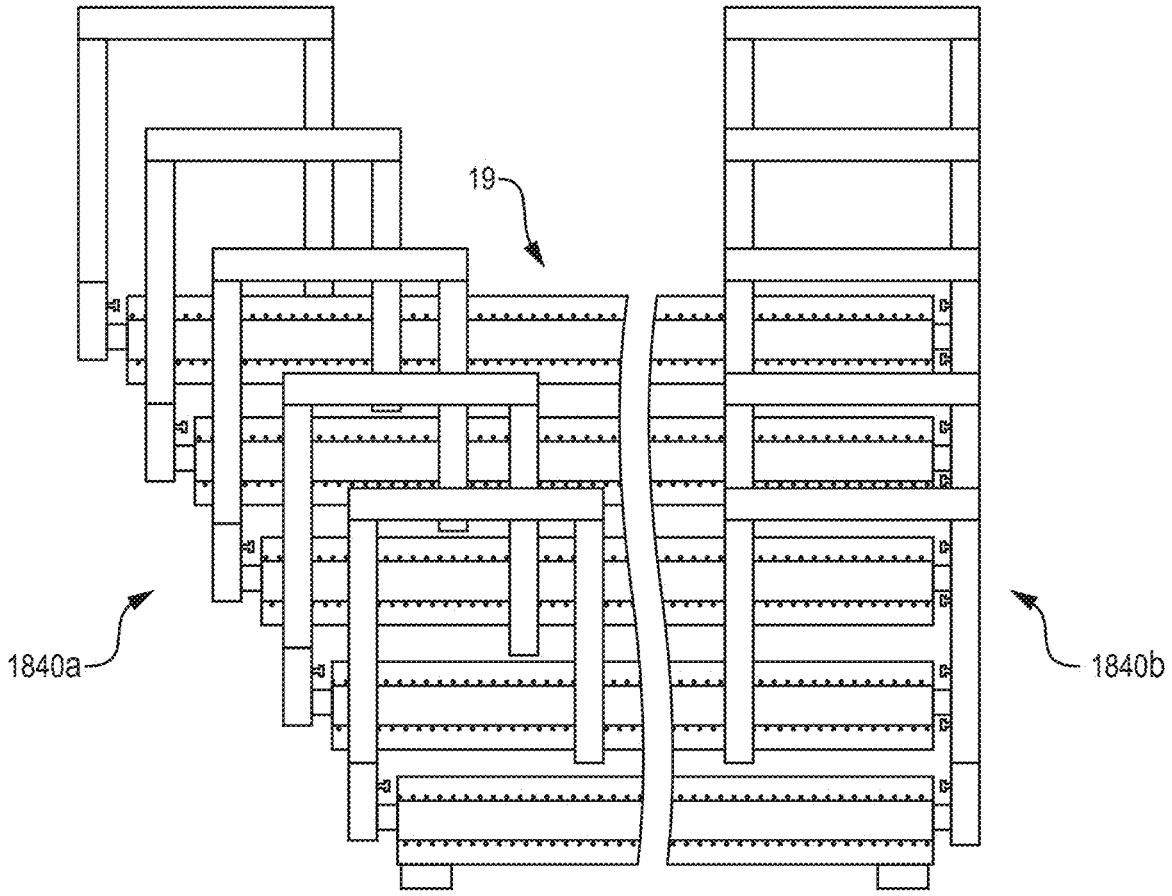
FIG. 19 is a front view of a seating structure with guardrails in storage positions.

FIG. 18A shows an example guardrail system 18 where the front sockets 1860 hold the guardrails 1833 at a forward-tilting angle *beta* with respect to axis A. This configuration minimizes the closed stack dimensions of the telescopic seating structure by allowing the multiple tiers of guardrails to "nest" when the structure is closed. FIG. 18B shows as an example tier 1830 with guardrail 1833 being held by front bracket 1860 against front beam 1835. This configuration allows the tiers 1830 to fully retract without guardrails 1833 of adjacent tiers 1830 impeding full retraction, allowing front sockets 1860 to align in a substantially vertically position. This configuration applies to both tapered ends 1840*a* and straight ends 1840*b* of seating structures 19 (see FIG. 19).

Figure 20A:
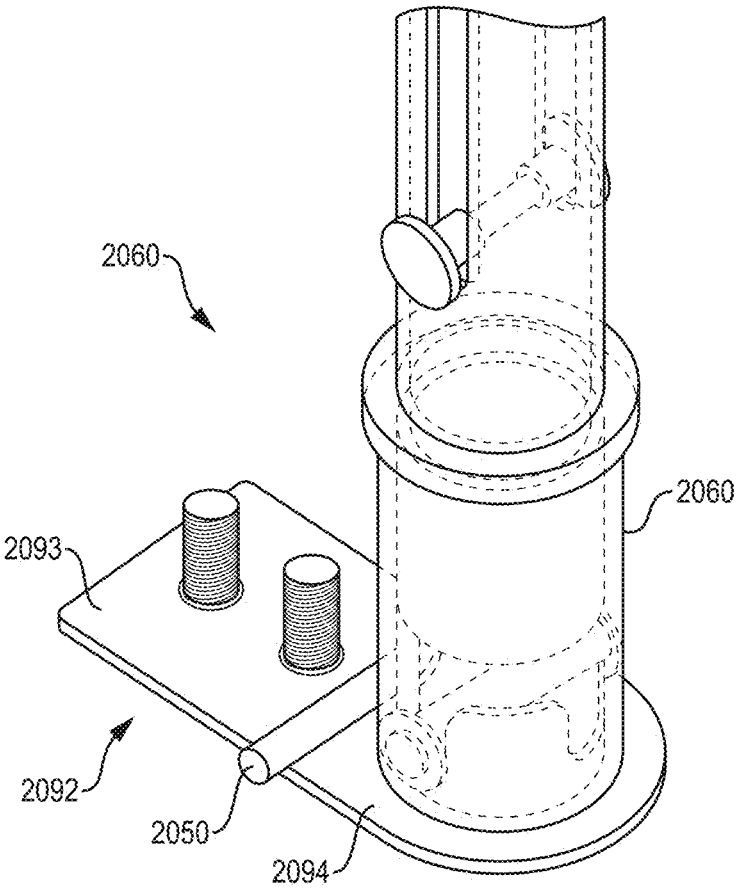
FIGS. 20A and 20 B, collectively referred to as FIG. 20, show an isometric and side view, respectively, of a hinged front bracket.
Figure 20B:
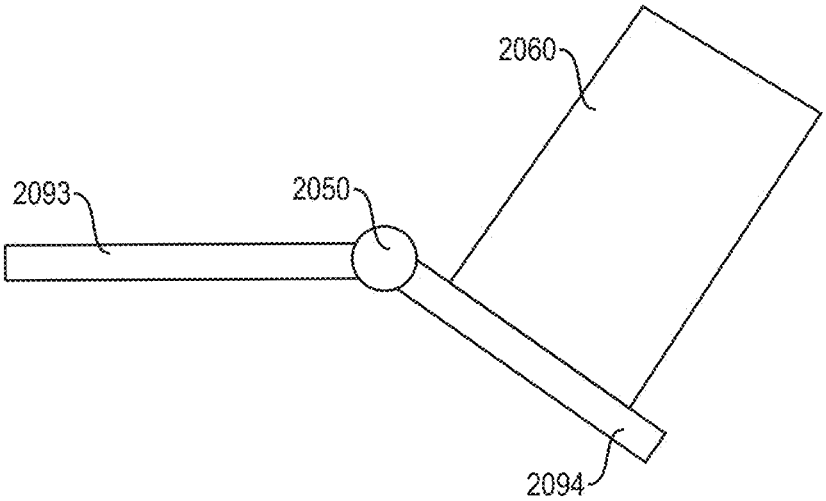
Figure 21A:
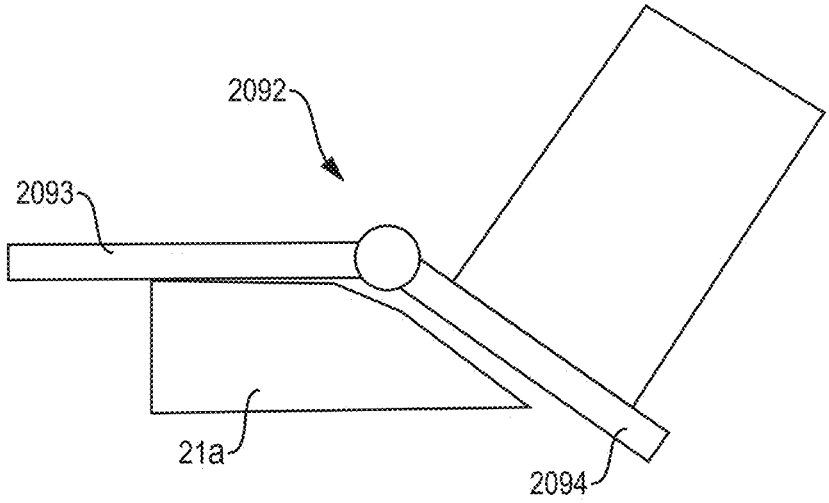
FIGS. 21A and 21B are side views of other hinged front bracket designs.
Figure 21B:
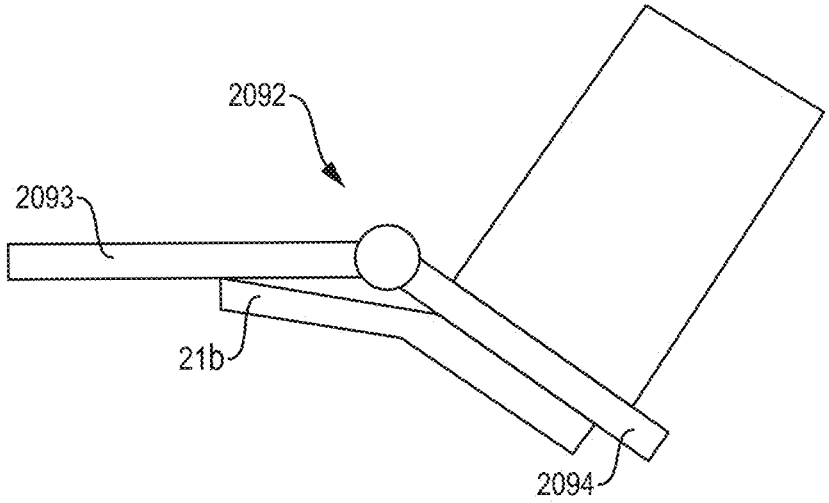

In some embodiments, storing guardrails at a forward slanting angle is accomplished using a hinged front socket 2060 as shown in FIGS. 20A and 20B. Bottom plate 2092 includes a back section 2093 with securing members to attach to a front socket bracket arm, and a front portion 2094 that is connected to the bracket with hinge 2050. This allows the receiver and cam structure of a front socket to pivot with a guardrail attached thereto as in the embodiments discussed above. The pivot action of the front socket 2060 can be limited by any traditional means, such as a bearing surface 21*a* (FIG. 21A) or a stop attachment 21*b* on the front portion 2094 of the bottom plate 2092 (FIG. 21B). The guardrail can be maintained in a horizontal in-use position by securing the rear leg of the guardrail in a rear socket as described above.

Figure 22A:
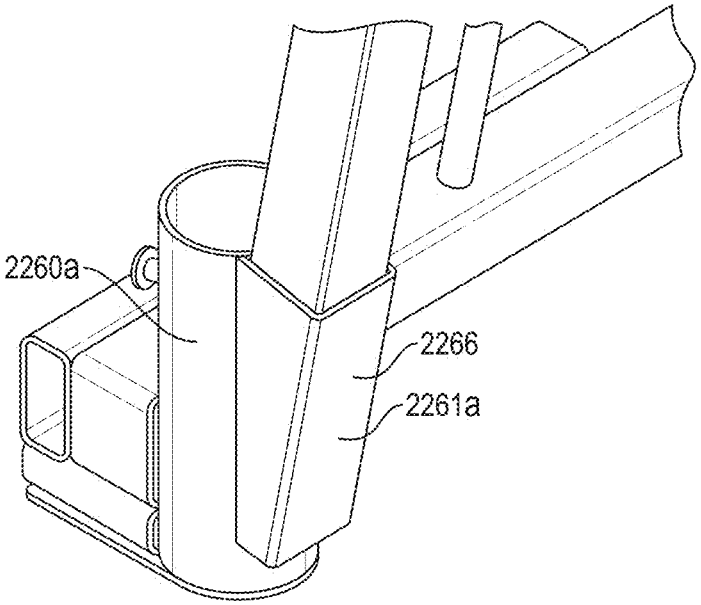
FIG. 22A is an isometric view of a front socket having separate receivers for holding a guardrail in vertical or tilted positions.
Figure 22B:
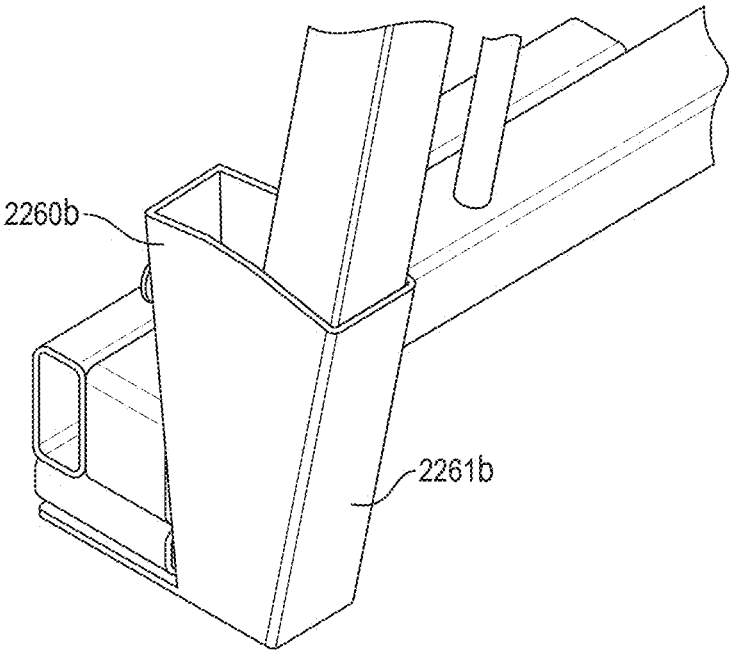
FIG. 22B is an isometric view of a front socket having a receiver for holding a guardrail in vertical and tilted positions.

In the embodiments shown in FIGS. 22A and 22B, the guardrail would not pivot but instead would be lifted out of the socket 2260*a* and placed back down to rest against a forward-sloped surface 2261*a* of the front socket 2260*a*. In some embodiments the forward-sloped surface 2261*a* is in a second receiver 2266 that is separate from the first receiver 2260*a* that holds the guardrail in a vertical position (FIG. 22A). In some embodiments, the forward-sloped surface 2261*b* is in the same receiver 2260*b* that holds the guardrail in a vertical position (FIG. 22B).

The present invention is not intended to be limited to a device or method that must satisfy one or more of any stated or implied objects or features of the invention and should not be limited to the preferred, exemplary, or primary example (s) or embodiments described herein.

Modifications and substitutions by one of ordinary skill in the art are considered to be within the scope of the present invention, which is not to be limited except by the allowed claims and their legal equivalents.

The invention claimed is:

1. A guardrail storage system, for securing an end guardrail of a tier of a multi-tiered telescopic seating structure in one of a use position substantially parallel to an end of the tier, and a storage position substantially parallel to a front beam of the tier, the system comprising:

the end guardrail having a front leg and a rear leg;

a front bracket attached to a tier adjacent the front beam of the tier and configured to secure the front leg of the end guardrail to the tier;

at least one locking mechanism, configured to prevent relative motion between the front bracket and the end guardrail secured in the front bracket;

whereby, upon disengagement of the at least one locking mechanism, the end guardrail is rotatable about a vertical axis from said use position substantially parallel to an end of the tier where the rear leg is proximate to a rear beam of the tier to said storage position substantially parallel to said front beam of said tier where the rear leg is adjacent to the front beam of the tier, and wherein the at least one locking mechanism rotationally secures the end guardrail against the tier when in the storage position.

2. The guardrail storage system of claim 1, wherein said front bracket attached to said tier adjacent the front beam of the tier is configured to secure the front leg of said end guardrail to said tier; and said guardrail storage system further including a rear bracket, attached to the rear beam of the tier, and configured for securing the rear leg of said end guardrail to an end region of said tier proximate the rear beam of said tier.

3. The guardrail storage system of claim 2, further comprising a position locking mechanism attached to the tier adjacent the front beam and spaced apart from the front bracket, wherein the rear leg is configured to engage the position locking mechanism in the storage position, and wherein the rear leg is configured to travel 90 degrees about the vertical axis between the rear bracket and the position locking mechanism.

4. The guardrail storage system of claim 1, wherein the front bracket includes a front receiver rigidly attached to the tier adjacent to the front beam and a post coupled to the front receiver and configured to receive the front leg, and wherein the at least one locking mechanism includes a first locking portion on the front receiver and a second locking portion on the post.

5. The guardrail storage system of claim 4, wherein the post includes a slot that extends along the vertical axis, wherein a slot follower is received within the slot and is connected to the front leg, and wherein the front leg is configured to translate along the vertical axis relative to the post via movement of the slot follower along the slot.

6. The guardrail storage system of claim 4, wherein the first locking portion includes a first register slot and a second register slot disposed perpendicular to the first register slot, and wherein the second locking portion includes a registration member configured to be received in the first register slot in the use position and in the second register slot in the storage position.

7. The guardrail storage system of claim 4, further comprising an alignment plate coupled to the post and configured to keep the post centered in the front bracket.

8. The guardrail storage system of claim 7, further comprising a locking member that extends through the front bracket and is configured to contact the alignment plate to limit translation along the vertical axis.

9. A method of transitioning a guardrail at an end of a tier of a telescopic multi-tiered seating system from an in-use position, wherein said guardrail is substantially parallel to an end of the tier, to a storage position wherein said guardrail is substantially parallel to a front beam of the tier prior to retracting the tiers of the seating system, the method comprising:

disengaging a rear leg of the guardrail from a rear bracket attached to a rear beam of a tier;

disengaging a locking device that holds the guardrail in said in-use position;

pivoting the rear leg of the guardrail about a vertical axis of a front bracket attached to the tier adjacent the front beam of the tier and configured to secure the guardrail to the tier in a storage position, wherein a front leg of the guardrail is coupled to the front bracket; and securing the guardrail in the storage position, where the rear leg is adjacent to the front beam of the tier in the storage position.

10. The method of claim 9, further comprising securing the rear leg to a position locking mechanism attached to the tier adjacent the front beam and spaced apart from the front bracket.

11. The method of claim 9, wherein the rear leg pivots 90 degrees between the in-use position and the storage position.

12. The method of claim 9, wherein the front bracket includes a front receiver rigidly attached to the tier adjacent to the front beam and a post coupled to the front receiver and configured to receive the front leg, and the locking device includes a first locking portion on the front receiver and a second locking portion on the post.

13. The method of claim 12, wherein the post includes a slot that extends along the vertical axis, wherein a slot follower is received within the slot and is connected to the front leg, and the method further comprising translating the front leg along the vertical axis relative to the post via movement of the slot follower along the slot.

14. The method of claim 12, wherein the first locking portion includes a first register slot and a second register slot disposed perpendicular to the first register slot, and wherein the second locking portion includes a registration member, the method further comprising moving the registration member between the first register slot in the in-use position and the second register slot in the storage position.

15. A guardrail storage system, for securing an end guardrail of a tier of a multi-tiered telescopic seating structure in one of a use position substantially parallel to an end of the tier, and a storage position substantially parallel to a front beam of the tier, the system comprising:

the end guardrail having a front leg and a rear leg;

a front bracket including a receiver attached to a tier adjacent the front beam of the tier and a post movably coupled to the receiver and configured to secure the front leg of the end guardrail to the tier;

at least one locking mechanism within the front bracket, configured to prevent relative motion between the receiver and the post;

whereby, upon disengagement of the at least one locking mechanism, the post is rotatable about a vertical axis to move the end guardrail from said use position where the rear leg is proximate to a rear beam of the tier to said storage position where the rear leg is adjacent to the front beam of the tier, and wherein the at least one locking mechanism rotationally secures the end guardrail against the tier when in the storage position.

16. The guardrail storage system of claim 15, further comprising a position locking mechanism attached to the tier adjacent the front beam and spaced apart from the front bracket, wherein the rear leg is configured to engage the position locking mechanism in the storage position, and wherein the rear leg is configured to travel 90 degrees about the vertical axis between the rear bracket and the position locking mechanism.

17. The guardrail storage system of claim 15, wherein the at least one locking mechanism includes a first locking portion on the receiver and a second locking portion on the post, wherein the first locking portion includes a first register slot and a second register slot disposed perpendicular to the first register slot, and wherein the second locking portion includes a registration member configured to be received in the first register slot in the use position and in the second register slot in the storage position.

18. The guardrail storage system of claim 15, wherein the post includes a slot that extends along the vertical axis, wherein a slot follower is received within the slot and is connected to the front leg, and wherein the front leg is configured to translate along the vertical axis relative to the post via movement of the slot follower along the slot.

19. The guardrail storage system of claim 15, wherein said guardrail storage system further including a rear bracket, attached to the rear beam of the tier, and configured for securing the rear leg of said end guardrail to an end region of said tier proximate the rear beam of said tier.

20. The guardrail storage system of claim 15, further comprising, an alignment plate coupled to the post and configured to keep the post centered in the front bracket, and a locking member that extends through the front bracket and is configured to contact the alignment plate to limit translation along the vertical axis.

* * * * *